US008475987B2

(12) United States Patent
Kaya et al.

(10) Patent No.: US 8,475,987 B2
(45) Date of Patent: Jul. 2, 2013

(54) YELLOW TONER

(75) Inventors: Takaaki Kaya, Suntou-gun (JP); Ayako Sekikawa, Susono (JP); Atsushi Tani, Suntou-gun (JP); Shigeto Tamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 12/988,207

(22) PCT Filed: Feb. 9, 2010

(86) PCT No.: PCT/JP2010/052235

§ 371 (c)(1),
(2), (4) Date: Oct. 15, 2010

(87) PCT Pub. No.: WO2010/098226

PCT Pub. Date: Sep. 2, 2010

(65) Prior Publication Data

US 2011/0039200 A1 Feb. 17, 2011

(30) Foreign Application Priority Data

Feb. 27, 2009 (JP) ..... 2009-046212

(51) Int. Cl.
*G03G 9/087* (2006.01)
*G03G 9/093* (2006.01)

(52) U.S. Cl.
USPC ..... 430/109.4; 430/110.2

(58) Field of Classification Search
USPC ..... 430/110.2, 109.4
See application file for complete search history.

(56) References Cited

U.S. PATENT DOCUMENTS

| | | | |
|---|---|---|---|
| 5,399,455 | A | 3/1995 | Mikami et al. |
| 5,620,826 | A | 4/1997 | Tavernier et al. |
| 6,664,016 | B2 | 12/2003 | Kanbayashi et al. |
| 6,751,424 | B2 | 6/2004 | Komatsu et al. |
| 6,905,808 | B2 | 6/2005 | Itakura et al. |
| 7,147,980 | B2 | 12/2006 | Itakura et al. |
| 7,229,727 | B2 | 6/2007 | Itakura et al. |

(Continued)

FOREIGN PATENT DOCUMENTS

| | | | |
|---|---|---|---|
| CN | 1614520 | A | 5/2005 |
| CN | 101067730 | A | 11/2007 |

(Continued)

OTHER PUBLICATIONS

European Search Report dated Oct. 24, 2012 in European Application No. 10746107.1.

(Continued)

*Primary Examiner* — Jonathan Jelsma
(74) *Attorney, Agent, or Firm* — Fitzpatrick, Cella, Harper & Scinto

(57) ABSTRACT

A yellow toner is provided which can form high-quality images and has high offset resistance and excellent charging performance while being a capsule-type toner having excellent low-temperature fixability. The yellow toner satisfies, in DSC measurement, $40.0 \leqq Tg(0.5) \leqq 60.0$ and $2.0 \leqq Tg(4.0) - Tg(0.5) \leqq 10.0$, wherein when the concentration of the yellow toner in an ethyl acetate dispersion is $C_{y1}$ (mg/ml) and the light absorbance at a wavelength of 422 nm of the dispersion is $A(\text{ethyl acetate})_{422}$, the relationship between $C_{y1}$ and $A(\text{ethyl acetate})_{422}$ satisfies $A(\text{ethyl acetate})_{422}/C_{y1} < 0.45$, and when the concentration of the yellow toner in a chloroform solution is $C_{y2}$ (mg/ml) and the light absorbance at a wavelength of 422 nm of the solution is $A(\text{chloroform})_{422}$, the relationship between $C_{y2}$ and $A(\text{chloroform})_{422}$ satisfies $6.00 < A(\text{chloroform})_{422}/C_{y2} < 14.4$.

8 Claims, 2 Drawing Sheets

U.S. PATENT DOCUMENTS

| | | | | |
|---|---|---|---|---|
| 7,244,539 | B2 | 7/2007 | Baba et al. | |
| 7,361,441 | B2 | 4/2008 | Itakura et al. | |
| 7,452,649 | B2 | 11/2008 | Magome et al. | |
| 7,544,457 | B2 | 6/2009 | Hashimoto et al. | |
| 7,718,338 | B2 | 5/2010 | Fujimoto et al. | |
| 7,776,501 | B2 | 8/2010 | Tamura et al. | |
| 7,794,908 | B2 | 9/2010 | Kaya et al. | |
| 7,794,909 | B2 | 9/2010 | Kaya et al. | |
| 7,816,063 | B2 | 10/2010 | Hashimoto et al. | |
| 7,875,413 | B2 | 1/2011 | Shibai et al. | |
| 2007/0015851 | A1 | 1/2007 | Akutagawa et al. | |
| 2007/0015852 | A1 | 1/2007 | Akutagawa et al. | |
| 2007/0111125 | A1 | 5/2007 | Tominaga et al. | |
| 2007/0275317 | A1 | 11/2007 | Fujimoto et al. | |
| 2008/0286668 | A1 | 11/2008 | Ishigami et al. | |
| 2008/0286675 | A1 | 11/2008 | Tani et al. | |
| 2009/0011353 | A1 | 1/2009 | Kaya et al. | |
| 2009/0162773 | A1 | 6/2009 | Fukui et al. | |
| 2009/0263738 | A1* | 10/2009 | Kaya et al. | 430/108.2 |
| 2009/0291380 | A1 | 11/2009 | Ayaki et al. | |
| 2009/0291383 | A1 | 11/2009 | Ayaki et al. | |
| 2010/0062355 | A1 | 3/2010 | Kaya et al. | |
| 2010/0119965 | A1 | 5/2010 | Tani et al. | |
| 2010/0273102 | A1 | 10/2010 | Tamura et al. | |
| 2010/0291482 | A1 | 11/2010 | Minami et al. | |
| 2011/0045398 | A1 | 2/2011 | Sekikawa et al. | |

FOREIGN PATENT DOCUMENTS

| | | | |
|---|---|---|---|
| JP | 5-297622 | A | 11/1993 |
| JP | 8-248680 | A | 9/1996 |
| JP | 3455523 | B2 | 10/2003 |
| JP | 2004-226572 | A | 8/2004 |
| JP | 2004-271919 | A | 9/2004 |
| JP | 2007-003840 | A | 1/2007 |
| JP | 2008-107679 | A | 5/2008 |
| JP | 2008-129308 | A | 6/2008 |
| JP | 2009-015212 | A | 1/2009 |
| WO | 20051073287 | A1 | 8/2005 |

OTHER PUBLICATIONS

Ayaki, et al., U.S. Appl. No. 12/972,396, filed Dec. 17, 2010.
Sekikawa, et al., U.S. Appl. No. 12/995,977, filed Feb. 19, 2010.
Chinese Office Action dated Aug. 30, 2012 in Chinese Application No. 201080009623.5.

* cited by examiner

YELLOW TONER

TECHNICAL FIELD

The present invention relates to a toner for use in a recording method employing an electrophotographic method, an electrostatic recording method, a toner jet system recording method or the like. More specifically, the present invention relates to a yellow toner used in a copying machine, a printer or a facsimile in which a fixed image by forming an electrostatic latent image is formed on an electrostatic latent image bearing member, the electrostatic latent image is transferred onto a transfer member to form a toner image, and the toner image is fixed with heat and pressure to form a fixed image.

BACKGROUND ART

In recent years, energy saving has been considered to be an important technical issue even in electrophotographic devices, and a drastic reduction in the amount of heat required by a fixing apparatus has been mentioned as one way to achieve this. Accordingly, a need for so-called "low-temperature fixability" in a toner, in which fixing with lower energy is possible, has been increasingly raised.

Conventionally, a technique involving increasing the sharp melt properties of a binder resin is known as an effective method to enable fixing to be performed at lower temperatures. In terms of this, polyester resins exhibit excellent characteristics.

On the other hand, from the separate viewpoint of improving image quality, reduction of the toner particle size and sharpening of the toner particle size distribution have progressed for the purpose of attaining higher resolution and higher definition. In addition, a spherical toner is now suitably used for the purpose of improving transfer efficiency and fluidity. As a method for efficiently preparing spherical toner particles with small particle sizes, a wet method is now used.

As a wet method capable of using a sharp-melting polyester resin, a "solution suspension" method has been proposed in which spherical toner particles are produced by dissolving a resin component in an organic solvent which is immiscible with water, and dispersing the resultant solution in an aqueous phase to thereby form oil droplets (see Japanese Patent Application Laid-Open No. H08-248680). According to this method, a spherical toner with a small particle size can be easily obtained in which polyester having excellent low-temperature fixability is used as a binder resin.

Further, for the toner particles produced by the above-described solution suspension method using polyester as a binder resin, capsule type toner particles have also been proposed for the purpose of attaining even further low-temperature fixability.

Japanese Patent Application Laid-Open No. H05-297622 proposes the following method.

An oil phase is prepared by dissolving and dispersing a polyester resin, a low-molecular-weight compound having an isocyanate group and other components in ethyl acetate, and droplets are prepared in water. Thereby, the compound having an isocyanate group is caused to undergo interfacial polymerization at the droplet interfaces to thereby produce capsule toner particles having polyurethane or polyurea as an outermost shell.

In addition, Japanese Patent Application Laid-Open No. 2004-226572 and Japanese Patent Application Laid-Open No. 2004-271919 propose methods in which toner base particles are prepared by a solution suspension method in the presence of resin fine particles formed from any one, or a combination of two or more, of a vinyl resin, polyurethane resin, epoxy resin and polyester resin, to thereby prepare toner particles each having a toner base particle surface covered with the above-described resin fine particles.

Japanese Patent No. 3,455,523 proposes toner particles obtained by a solution suspension method using urethane-modified polyester resin fine particles as a dispersant.

International Application No. WO 2005/073287 proposes core-shell type toner particles formed by a shell layer (P) having one or more film-like layers formed from a polyurethane resin (a) and a core layer (Q) having one layer formed from a resin (b).

In these core-shell type toner particles, the viscosity of the core portion is lowered and the poor heat-resistant storage stability of the core portion is compensated with the heat-resistant storage stability of a shell portion. In this case, since a substance which is relatively strong against heat is used as the shell part, it is necessary to highly cross-link the substance or to use a substance having a high molecular weight. Consequently, there is a tendency for low-temperature fixability to be inhibited.

On the other hand, if the addition amount of the coloring material in the toner is increased, the coloring power of the toner is increased and the consumption of the toner is decreased by controlling the dispersion state of a colorant. By decreasing the consumption of the toner, high-quality line and character images with reduced scattering can be provided. Further, on a sheet of paper, uneven portions are reduced and gloss is uniformized. Moreover, due to the decreased consumption of the toner, the toner container and the electrophotographic apparatus can be miniaturized. In addition, running costs can be reduced, and power consumption can be decreased.

However, if the added amount of the coloring material in the toner is simply increased, due to dispersion defects, for a color toner, the color gamut is liable to narrow, and fixing inhibition tends to occur as a result of an increase in toner hardness owing to filler effect. Further, a large amount of colorant comes out of the toner particle surface and tends to contaminate the carrier part and sleeve part for a two-component developer. Moreover, when the moisture absorption properties of the colorant on the surface are high, a difference in charge amount tends to occur depending on environments.

While these effects are noticeable for a black toner using carbon black, even when a yellow toner is used, these effects tend to occur if the addition amount of the coloring material is increased. Therefore, there is a need for improving the technology of dispersing a colorant for each color.

DISCLOSURE OF THE INVENTION

The present invention was made in view of the above-described problems, and an object of the present invention is to provide a yellow toner having high offset resistance and excellent charging performance while being a capsule type toner having excellent low-temperature fixability. Another object of the present invention is to provide high-quality images in which the characters, lines, and dots are fine. A further object of the present invention is to provide a spherical yellow toner which has a small particle size and a sharp particle size distribution.

The yellow toner of the present invention includes a toner particle having at least a resin (a) having a polyester as a main component, a colorant, and a wax, and is characterized by satisfying the following formulas (1) and (2) in DSC measurement:

$$40.0 \leqq Tg(0.5) \leqq 60.0 \quad (1)$$

$$2.0 \leqq Tg(4.0) - Tg(0.5) \leqq 10.0 \quad (2)$$

(wherein Tg(0.5) is a glass transition temperature (° C.) obtained at a rate of temperature rise of 0.5° C./min, and Tg(4.0) is a glass transition temperature (° C.) obtained at a rate of temperature rise of 4.0° C./min)

wherein when the concentration of the yellow toner in an ethyl acetate dispersion is $C_{y1}$ (mg/ml), and the light absorbance of the dispersion at a wavelength of 422 nm is A(ethyl acetate)$_{422}$, the relationship between $C_{y1}$ and A(ethyl acetate)$_{422}$ satisfies the following formula (3):

$$A(\text{ethyl acetate})_{422}/C_{y1}<0.45 \quad (3)$$

and when the concentration of the yellow toner in a chloroform solution is $C_{y2}$ (mg/ml), and the light absorbance of the solution at a wavelength of 422 nm is A(chloroform)$_{422}$, the relationship between $C_{y2}$ and A(chloroform)$_{422}$ satisfies the following formula (4):

$$6.00<A(\text{chloroform})_{422}/C_{y2}<14.4 \quad (4).$$

According to the present invention, toner base particles (A) have properties such as low viscosity, release properties and coloration. Therefore, excellent low-temperature fixability can be realized.

According to a preferred embodiment of the present invention, the coloring power of the toner base particles can be increased, and the toner consumption can be decreased, so that high-quality line and character images with reduced scattering can be provided. Further, irregularities due to toner on a sheet of paper are reduced, and as a result, gloss can be more uniformized and more natural images can be obtained.

Further, a surface layer (B) with functions relating to heat-resistant storage stability and developability is provided to inhibit the colorant to be exposed to the toner surface, thereby making it possible to provide a yellow toner excellent in charging performance while having high coloring power. Consequently, problems such as toner scattering and fogging can be resolved. In addition, the effects of the interior shell having low viscosity is suppressed, so that a yellow toner can be provided which can satisfy the characteristics required for electrophotographic properties such as charging performance, developability, transferability and cleaning performance.

Further features of the present invention will become apparent from the following description of exemplary embodiments with reference to the attached drawings.

BEST MODES FOR CARRYING OUT THE INVENTION

Figure 1:
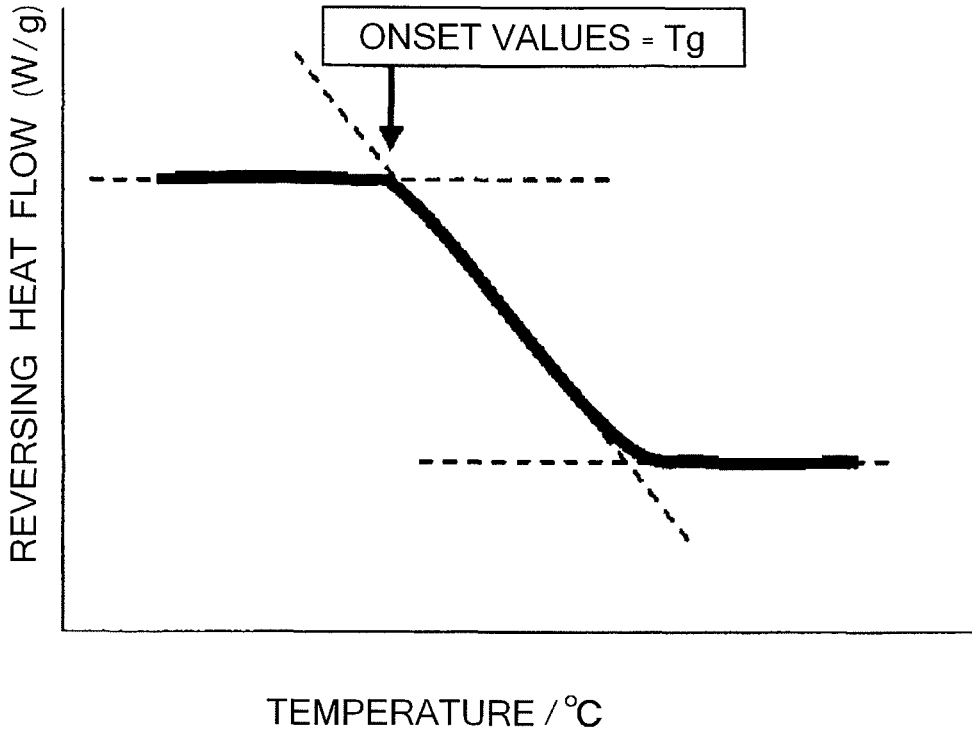
FIG. 1 illustrates a method for calculating Tg from a DSC curve.

The yellow toner according to the present invention is a capsule type (core-shell type) toner, which has a shell layer with comparatively high viscosity as a surface layer. By employing such a configuration, during storage the toner is less susceptible to the effects of the core portion (including the colorant and the wax). However, for an imperfect capsule-type toner, it is difficult to combine low-temperature fixability with heat-resistant storage stability, so that development stability tends to deteriorate. Especially, this tendency becomes stronger for systems with a high coloring power in which the effects of the core are noticeable.

To obtain good low-temperature fixability, it is effective to employ a toner design having a low glass transition temperature. However, to also achieve heat-resistance storage properties, it is preferred to design so that the glass transition temperature is in a suitable temperature range. Further, also for storage stability of images, it is preferred to design the toner to have a suitable glass transition temperature.

The yellow toner according to the present invention is characterized in that a glass transition temperature Tg(0.5) at a rate of temperature increase of 0.5° C./min satisfies the following relationship.

$$40.0 \leqq Tg(0.5) \leqq 60.0 \quad (1)$$

Tg(0.5) is preferably 42.0° C. or more to 58.0° C. or less. If Tg(0.5) is less than 40.0° C., although fixability at low temperatures is excellent, problems such as winding and offsetting at high temperatures tend to occur, so that the temperature range for fixing tends to narrow. Further, stability during storage of the toner tends to be harmed, and the stability during image storage after fixing tends to deteriorate. If Tg(0.5) is more than 60.0° C., it is difficult to realize low-temperature fixability.

In addition, the yellow toner according to the present invention is characterized in that, when a rate of temperature increase was varied in glass transition temperature measurement, the glass transition temperature satisfies the following relationship:

$$2.0 \leqq Tg(4.0)-Tg(0.5) \leqq 10.0 \quad (2)$$

wherein Tg(0.5) represents the glass transition temperature (° C.) obtained at a rate of temperature increase of 0.5° C./min, and Tg(4.0) represents the glass transition temperature (° C.) obtained at a rate of temperature increase of 4.0° C./min.

Tg(4.0)−Tg(0.5) is preferably 2.5° C. or more to 8.0° C. or less. If Tg(4.0)−Tg(0.5) is smaller than 2.0° C., the heat-resistant storage stability tends to be insufficient, and the toner is susceptible to the effects of the wax and the colorant. Further, if Tg(4.0)−Tg(0.5) is larger than 10.0° C., while the toner has a capsule structure, low-temperature fixability may not be exhibited, wax exudation tends to become insufficient, and winding on the fixing part tends to occur.

Further, if the concentration of the yellow toner in an ethyl acetate dispersion is Cy1 (mg/ml), and the light absorbance of this dispersion at a wavelength of 422 nm is A(ethyl acetate)$_{422}$, the relationship between $C_{y1}$ and A(ethyl acetate)$_{422}$ satisfies the following equation (3).

$$A(\text{ethyl acetate})_{422}/C_{y1}<0.45 \quad (3)$$

If A(ethyl acetate)$_{422}$/$C_{y1}$ is 0.45 or more, the colorant is not sufficiently dispersed in the toner, and is present near the surface. In such a case, it is difficult to form a good capsule structure. Thus, this tends to become a cause of deterioration in charging and part contamination. Therefore, the A(ethyl acetate)$_{422}$/$C_{y1}$ value may be 0.45 or less, and is preferably 0.30 or less. More preferably, the A(ethyl acetate)$_{422}$/$C_{y1}$ value is 0.20 or less.

Further, if the concentration of the yellow toner in a chloroform solution is $C_{y2}$ (mg/ml), and the light absorbance of this solution at a wavelength of 422 nm is A(chloroform)$_{422}$, the relationship between $C_{y2}$ and A(chloroform)$_{422}$ satisfies the following equation (4).

$$6.00<A(\text{chloroform})_{422}/C_{y2}<14.40 \quad (4)$$

From the perspective of obtaining a high coloring power, the above-described A(chloroform)$_{422}$/$C_{y2}$ is more preferably more than 7.00 and less than 12.00. When A(Chloroform)$_{422}$/

$C_{y2}$ is 6.00 or less, the coloring power per unit mass of the toner decreases. Consequently, to obtain the necessary coloring power, the toner amount laid on the recording paper need be increased, and the toner layer need be made thicker. Therefore, the consumption of the toner cannot be reduced. Moreover, spattering tends to occur during transfer/fixing, and a "missing transfer" phenomenon may occur, in which the center portion of a line image or a character image is not transferred, and only an edge portion is transferred. On the other hand, if $A(\text{chloroform})_{422}/C_{y2}$ is 14.40 or more, although sufficient coloring power can be obtained, brightness tends to deteriorate, the image tends to become darker, and vividness tends to deteriorate.

The yellow toner according to the present invention has a core-shell structure, and preferably includes toner particles each having a surface layer (B) containing a resin (b) as a main component, on the surface of each of toner base particles (A) containing the resin (a) which has a polyester as a main component. Further, if the glass transition temperature (° C.) of the resin (b) is Tg(b), and the glass transition temperature (° C.) of the resin (a) is Tg(a), the following relationships are preferably satisfied.

$$40.0 \leqq Tg(a) \leqq 60.0 \quad (5)$$

$$50.0 \leqq Tg(b) \leqq 80.0 \quad (6)$$

$$Tg(a)+5 \leqq Tg(b) \quad (7)$$

If Tg(a) is in the above-described temperature range, the problems of winding and offsetting at high temperatures can be well suppressed, and a sufficient fixable temperature range can be secured. If Tg(b) is in the above-described temperature range, good heat-resistant storage stability can be obtained even for a toner such as that of the present invention which is aimed at low-temperature fixing.

It is preferred that Tg(b) is greater than Tg(a) by 5° C. or more. If Tg(b) is not 5° C. greater than Tg(a), the effects of the characteristics of the resin (a) become stronger. Consequently, it becomes more difficult for the effects of combining heat-resistant storage stability and low-temperature fixability, which is a merit of encapsulation, to be exhibited.

The yellow toner according to the present invention may have a storage elastic modulus G' at 130° C. (G'130) of $1.0\times10^3$ dN/m$^2$ or more to $1.0\times10^5$ dN/m$^2$ or less. G'130 means the elasticity at a fixing nip. When the G'130 is in this range, the combination of high-temperature offset properties and low-temperature fixability can be better achieved. More preferably, the G'130 is $3.0\times10^3$ dN/m$^2$ or more to $5.0\times10^4$ dN/m$^2$ or less. The maximum value of the above-described loss elastic modulus G" and the G'130 can satisfy the above-described ranges by adjusting the viscoelasticities and the like of the resin (a) and resin (b).

The yellow toner according to the present invention preferably has an average circularity of 0.960 or more to 1.000 or less. If the average circularity of the toner is in this range, good transfer efficiency can be obtained. More preferably, the average circularity of the toner is 0.965 or more to 0.990 or less.

In the present invention, a weight average particle size (D4) of the yellow toner is preferably 4.0 μm or more to 9.0 μm or less, and more preferably 4.5 to 7.0 μm. If the weight average particle size of the toner is in this range, the occurrence of charge-up of the toner can be well suppressed even after using for a long time. Further, problems such as the density deteriorating can be suppressed. In addition, good thin line reproducibility can be obtained in a line image or the like.

In the yellow toner according to the present invention, the number of particles of 0.6 μm or more to 2.0 μm or less is preferably 2.0% or less. If there are a large number of fine particles of 2.0 μm or less, agent contamination and charge amount fluctuation are liable to be caused. Consequently, problems such as density reduction, scattering and fogging after prolonged image output tend to occur. More preferably, such number of particles is 1.5% or less.

The yellow toner according to the present invention preferably has a ratio (D4/D1) of the weight average particle size (D4) to a number average particle size (D1) of 1.00 or more to 1.25 or less, and more preferably of 1.00 or more to 1.20 or less.

It is preferable that the surface layer (B) accounts for 2.0 mass % or more to 15.0 mass % or less of the toner base particle (A). If the ratio accounted for by the surface layer (B) is in this range, the thickness of the shell portion is suitable, the influence of the toner base particles (A) can be prevented during storage, and the expression of the sharp melt properties possessed by the toner base particles (A) is not prevented during fixing. More preferably the ratio accounted for by the surface layer (B) is 3.0 mass % or more to 14.0 mass % or less, and even more preferably 4.0 mass % or more to 12.0 mass % or less.

The yellow toner according to the present invention preferably has a maximum value of the loss elastic modulus G" between 40° C. and 60° C., inclusive thereof, in viscoelastic measurement, and more preferably between 42° C. and 58° C., inclusive thereof.

The toner base particles (A) used in the present invention will now be described in more detail.

The toner base particles (A) used in the present invention include at least a resin (a) having polyester as a main component, a colorant, and a wax. Further, in addition to these, the toner base particles (A) may optionally include other additives.

The resin (a) used in the present invention includes polyester as a main component. Here, the term "main component" means that the polyester accounts for 50 mass % or more of the total amount of the resin (a). For the polyester, it is preferred to use polyester using as a main component(s) an aliphatic diol and/or an aromatic diol as an alcohol component.

The aliphatic diol preferably has 2 to 8 carbon atoms, and more preferably 2 to 6 carbon atoms.

Specific examples of the diol include diols such as ethylene glycol, 1,2-propylene glycol, 1,3-propylene glycol, 1,4-butane diol, 1,5-pentane diol, 1,6-hexane diol, neopentyl glycol, 1,4-butene diol, 1,7-heptane diol, and 1,8-octane diol; and glycerin. Of those, an α,ω-linear alkanediol is preferred and 1,4-butane diol and 1,6-hexanediol are more preferred. Further, from the viewpoint of durability, the content of the aliphatic diol is preferably 30 to 100 mol % and more preferably 50 to 100 mol % of the alcohol component constituting the polyester.

Examples of the aromatic diol include polyoxypropylene (2.2)-2,2-bis(4-hydroxyphenyl)propane and polyoxyethylene(2.2)-2,2-bis(4-hydroxyphenyl)propane.

Examples of the carboxylic acid component constituting the polyester include aromatic polycarboxylic acids, such as phthalic acid, isophthalic acid, terephthalic acid, trimellitic acid, and pyromellitic acid; aliphatic polycarboxylic acids such as fumaric acid, maleic acid, adipic acid, succinic acid, and succinic acid substituted with an alkyl group having 1 to 20 carbon atoms or an alkenyl group having 2 to 20 carbon atoms such as dodecenyl succinic acid and octenyl succinic acid; anhydrides of those acids; and alkyl (having 1 to 8 carbon atoms) esters of those acids.

From the viewpoint of the charging performance, the carboxylic acid may include an aromatic polycarboxylic acid compound. The content thereof is preferably 30 to 100 mol % and more preferably 50 to 100 mol % of the carboxylic acid component constituting the polyester.

In addition, a raw material monomer may include, from the viewpoint of fixability, a trivalent or more polyhydric alcohol and/or trivalent or more polycarboxylic acid compound.

The method for producing the polyester is not specifically limited and may follow a known method. For example, in an inert gas atmosphere, the alcohol component and the carboxylic acid component are subjected to condensation polymerization at a temperature of 180 to 250° C. optionally using an esterification catalyst.

The resin (a) preferably includes, as a main component, a polyester which uses the above-described aliphatic diol as an alcohol component. On the other hand, even if the resin (a) includes a polyester using a bisphenol monomer as the alcohol component, no large difference can be seen in the melting characteristics of the resin (a). However, because the granulation properties are affected by a relationship with the resin (b), which is the main component of the surface layer, it is preferred to appropriately select a suitable polyester.

The resin (a) may include other polyester resins, styrene-acrylic resins, a mixed resin of polyester and styrene acryl, epoxy resins and the like. In such a case, the content of the polyester using the aliphatic diol in the above-described predetermined amount as the alcohol component is preferably 50 mass % or more, and more preferably 70 mass % or more, based on the total amount of the resin (a).

Further, in the present invention, the peak molecular weight of the resin (a) is preferably 8,000 or less, and more preferably 3,000 or more to less than 5,500. In addition, the ratio of the resin (a) having a molecular weight of 100,000 or more is preferably 5.0% or less, and more preferably 1.0% or less.

If the molecular weight of the resin (a) satisfies the above stipulations, better fixability can be obtained.

In the present invention, the ratio of the resin (a) having a molecular weight of 1,000 or less is preferably 10.0% or less, and more preferably less than 7.0%.

If the ratio is in the above range, part contamination can be better suppressed.

In the present invention, in order to set the ratio of the resin (a) having a molecular weight of 1,000 or less to be 10.0% or less, the following preparation method can be suitably used. To reduce the ratio of the resin (a) having a molecular weight of 1,000 or less, the binder resin is dissolved in a solvent, and the resultant solution is brought into contact with water and left standing, which allows the ratio of the resin (a) having a molecular weight of 1,000 or less to be effectively reduced. More specifically, by this operation, the low-molecular-weight component having a molecular weight of 1,000 or less dissolves into the water, and can be efficiently removed from the resin solution.

For the above-described reason, the solution suspension method is preferably used as a method for producing the toner. By using a method in which a solution in which the resin (a), the colorant and the wax are dissolved or dispersed is left standing while the solution is in contact with an aqueous medium before being suspended in the aqueous medium, the low-molecular-weight component can be removed efficiently.

In the present invention, it is preferred to previously disperse the colorant in the resin (a), as the dispersibility of the colorant increases. From the perspective of dispersibility, the resin for dispersing the colorant is preferably a polyester produced using bisphenol A as a main component of the dialcohol. The resin (a) preferably has an acid value of 15 mg KOH/g or more to 30 mg KOH/g or less, and a weight average molecular weight (Mw) of 30,000 or less. By setting in these ranges, agglomeration of the colorant can be prevented and the amount of colorant being liberated from the toner particles can be reduced.

In the present invention, in order to adjust the molecular weight of the toner, resins having two or more molecular weights may be mixed and used.

In the present invention, in the resin (a), a crystalline polyester may be included as a component constituting the resin (a). As the crystalline polyester, preferred is a resin obtained by subjecting an alcohol component mainly composed of an aliphatic diol and a carboxylic acid component mainly composed of an aliphatic dicarboxylic acid compound to condensation polymerization.

This crystalline polyester is preferably a resin obtained by subjecting an alcohol component including 60 mol % or more of an aliphatic diol having 2 to 6 carbon atoms (preferably 4 to 6 carbon atoms), and a carboxylic acid component including 60 mol % or more of an aliphatic dicarboxylic acid compound having 2 to 8 carbon atoms (preferably 4 to 6 carbon atoms, and more preferably 4 carbon atoms) to condensation polymerization.

Examples of the aliphatic diol having 2 to 6 carbon atoms used to obtain the crystalline polyester include ethylene glycol, 1,4-butanediol, 1,5-pentanediol, 1,6-hexanediol, and 1,4-butene diol. Of those, 1,4-butanediol and 1,6-hexane diol are preferred.

Examples of the aliphatic dicarboxylic acid compound having 2 to 8 carbon atoms which constitutes the above crystalline polyester include oxalic acid, malonic acid, maleic acid, fumaric acid, citraconic acid, itaconic acid, glutaconic acid, succinic acid, adipic acid, and anhydrides and alkyl (having 1 to 3 carbon atoms) esters of these acids. Of those, fumaric acid and adipic acid are preferable, and fumaric acid is particularly preferable.

The crystalline polyester can be obtained, for example, by subjecting the alcohol component and the carboxylic acid component to condensation polymerization by reacting at a temperature of 150 to 250° C. in an inert gas atmosphere and optionally using an esterification catalyst.

Examples of the wax used in the present invention include aliphatic hydrocarbon waxes such as a low-molecular-weight polyethylene, low-molecular-weight polypropylene and low-molecular-weight olefin copolymer, and a microcrystalline wax, paraffin wax and a Fischer-Tropsch wax; oxides of aliphatic hydrocarbon waxes such as polyethylene oxide wax; waxes mainly formed from fatty acid esters, such as aliphatic hydrocarbon ester waxes; partially or wholly deacidified fatty acid esters such as a deacidified carnauba wax; partially esterified compounds of fatty acids and polyhydric alcohols such as behenic monoglyceride; and methyl ester compounds having a hydroxyl group obtained by the hydrogenation of a vegetable oil.

In the present invention, in the solution suspension method, from the perspective of ease of producing a wax dispersion, ease of incorporating the wax into the toner during granulation, exudation properties from the toner during fixing, and release properties after fixing, it is particularly preferred to use an ester wax.

Either a natural ester wax or a synthetic ester wax may be used as the ester wax. Further, these waxes may be partially saponified.

Examples of the synthetic ester wax include monoester waxes synthesized from a long, linear, saturated fatty acid and a long, linear, saturated alcohol. It is preferred to use a long, linear, saturated fatty acid having about 6 to 29 carbon atoms, and a long, linear, saturated alcohol having about 5 to 28 carbon atoms.

Examples of the natural ester waxes include candelilla wax, carnauba wax, rice wax, haze wax, jojoba oil, bees wax, lanoline, castor wax, montan wax, and derivatives thereof.

The reason for this is not clear, but is presumed to be that when the wax has a linear structure, its mobility in a melted state increases. Namely, it is necessary during fixing for the wax to pass between substances which have comparatively high polarities, such as the polyester acting as the binder resin and the reaction product of a diol and a diisocyanate on the surface layer, and to exude on the toner surface layer. Therefore, to pass between those high polarity substances, the fact that the wax has a linear structure is thought to act advantageously.

Further, in the present invention, the ester has a linear structure, and besides, is preferably a monoester. As with the reason as described above, the reason for this is that if the wax has a bulky structure in which each ester is bound to a branched chain, it may be difficult for the wax to exude on the surface by passing through the high polarity substances such as the polyester and the surface layer of the present invention.

In addition, the use of the ester wax in combination with a hydrocarbon wax is a preferred embodiment of the present invention.

In the present invention, the content of the wax in the toner is preferably 5.0 to 20.0 mass %, and more preferably 5.0 to 15.0 mass %. If the wax content is less than 5.0 mass %, the toner release properties cannot be maintained. If the wax content is more than 20.0 mass %, the wax tends to be exposed on the toner surface, which may cause the heat-resistant storage stability to deteriorate.

In the present invention, the wax may have a peak temperature of a maximum endothermic peak at 60° C. or more to 90° C. or less in a differential scanning calorimetry (DSC). When the peak temperature is in this range, the wax is suitably melted during fixing, and good low-temperature fixability and offset resistance can be obtained. In addition, exposure of the wax on the toner surface during storage can be suppressed, and deterioration of the heat-resistant storage stability can be suppressed.

Examples of the colorant used in the yellow toner according to the present invention include the following.

Examples of the colorant for yellow as a pigment include C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183 and 191; C.I. Vat Yellow 1, 3 and 20.

Examples of the colorant for yellow as a dye include C.I. Solvent Yellow 19, 44, 77, 79, 81, 82, 93, 98, 103, 104, 112 and 162. These may be added each singly or in combination.

In the present invention, if a dye or pigment which has extremely high solubility in water is used as the colorant, the dye or the pigment dissolves in the water during the production process, granulation is disrupted, and the desired coloring power may not be obtained.

In the present invention, the colorant content may be 7.0 mass % or more to 22.0 mass % or less based on the toner. If the content is less than 7.0 mass %, when used in a system with a reduced toner laid-on amount, coloring power deteriorates. On the other hand, if the content is more than 22.0 mass %, the toner viscosity increases and the sharp melt properties are harmed due to dispersion defects and the filler effect. Consequently, the color space is reduced, which results in deterioration in fixing performance at low temperatures. More preferably, the colorant content is 9.0 mass % or more to 20.0 mass % or less.

In an image of toner particles obtained by taking an enlarged photograph of a cross-section of the toner particles, the colorant preferably has a number average particle size of 200 nm or less, and more preferably of 150 nm or less. Further, the number average particle size is preferably 50 nm or more. If the number average particle size is more than 200 nm, the colorant tends to be exposed from the shell material, which tends to cause deterioration in the coloring power and to narrow the color gamut.

In the present invention, a charge control agent may optionally be used. The charge control agent may be included in the toner base particle (A) or the surface layer (B).

Examples of the charge control agent which can be used in the present invention include known charge control agents.

For example, negative charge control agents such as metallic compounds of aromatic carboxylic acids such as salicylic acid, alkyl salicylic acid, dialkyl salicylic acid, naphthoic acid and dicarboxylic acids, metal salts or metal complexes of azo dyes or azo pigments, polymer compounds having a sulfonic acid or a carboxylic acid group in a side chain, boron compounds, urea compounds, silicon compounds, calixarenes and the like. Additional examples include positive charge control agents, such as quaternary ammonium salts, polymer compounds having such a quaternary ammonium salt in a side chain, guanidine compounds, nigrosine compounds, imidazole compounds and the like.

Next, the surface layer (B) will be described.

The surface layer (B) preferably includes a resin (b). Examples of the resin (b) include vinyl resins, polyurethane resins, epoxy resins, polyester resins, polyamide resins, polyimide resins, silicon resins, phenol resins, melamine resins, urea resins, aniline resins, ionomer resins, polycarbonate resins and the like.

Two or more types of these resins may be used as the resin (b).

Of these, from the viewpoint of easily obtaining an aqueous dispersion of fine spherical resin particles, vinyl resins, polyurethane resins, epoxy resins, and polyester resins are preferred.

To reduce the viscosity of the surface layer (B) during fixing, polyurethane resins and polyester resins having polyester as a constituent are preferred. From the standpoints of exhibiting suitable affinity with the solvent, water dispersibility, viscosity adjustment and ease of achieving uniform particle size, the resin (b) preferably contains a resin which is a reaction product of a diol component and a diisocyanate component. Polyurethane resin is especially preferred. The surface layer (B) may be provided with various functions. Especially, because the surface influences the charge performance of the toner, a resin having charge controllability may be used in the surface layer.

The polyurethane resin will now be described in more detail.

The urethane resin is a reaction product of a prepolymer diol component and a diisocyanate component. Resins with various functionalities can be obtained by adjusting the diol component and the diisocyanate component.

Examples of the diisocyanate component include aromatic diisocyanates having 6 to 20 carbon atoms (excluding the carbon atoms in the NCO groups, hereinafter the same is applied), aliphatic diisocyanates having 2 to 18 carbon atoms, alicyclic diisocyanates having 4 to 15 carbon atoms, aromatic hydrocarbon diisocyanates having 8 to 15 carbon atoms, and modified diisocyanate thereof (modified substances having a urethane group, carbodiimide group, allophanate group, urea group, biuret group, urethodione group, urethoimine group, isocyanurate group, or oxazolidone group (hereinafter referred to also as "modified diisocyanate"), and a mixture of two or more types thereof.

Examples of the aromatic diisocyanate include, but are not limited to, 1,3-phenylene diisocyanate, 1,4-phenylene diisocyanate, and 1,5-naphthylene diisocyanate.

Examples of the aliphatic diisocyanate include ethylene diisocyanate, tetramethylene diisocyanate, hexamethylene diisocyanate (HDI), and dodecamethylene diisocyanate.

Examples of the alicyclic diisocyanate include isophorone diisocyanate (IPDI), dicyclohexylmethane-4,4'-diisocyanate (MDI), cyclohexylene diisocyanate, and methylcyclohexylene diisocyanate (TDI).

Of those, preferred are an aromatic diisocyanate having 6 to 15 carbon atoms, an aliphatic diisocyanate having 4 to 12 carbon atoms, and an alicyclic diisocyanate having 4 to 15 carbon atoms. Especially preferred are HDI and IPDI.

In addition, as the urethane resin (b), an isocyanate compound having three or more functional groups may be used in addition to the above-mentioned diisocyanate components. Examples of isocyanate compounds having three or more functional groups include polyallyl polyisocyanate (PAPI), 4,4',4"-triphenylmethane triisocyanate, m-isocyanato phenylsulfonyl isocyanate, and p-isocyanato phenyl sulfonyl isocyanate.

Examples of the diol component that can be used in the urethane resin (b) include alkylene glycols (ethyleneglycol, 1,2-propylene glycol, 1,3-propylene glycol, 1,4-butane diol, 1,6-hexane diol, octane diol, and decane diol); alkylene ether glycols (diethylene glycol, triethyleneglycol, dipropyleneglycol, polyethyleneglycol, and polypropylene glycol); alicyclic diols (1,4-cyclohexane dimethanol, hydrogenated bisphenol A and the like); bisphenols (bisphenol A, bisphenol F, bisphenol S and the like); alkylene oxide (ethylene oxide, propylene oxide, butylene oxide, and the like) adducts of the above-described alicyclic diols; alkylene oxide (ethylene oxide, propylene oxide, butylene oxide, and the like) adducts of the above-described bisphenols; polylactone diols (poly-ε-caprolactonediol and the like) and polybutadiene diol.

The alkyl moiety of the alkylene ether glycol may be linear or branched. In the present invention, alkylene glycol having a branched structure is preferably used.

Of those, preferred is an alkyl structure in view of solubility (affinity) with ethyl acetate, and an alkylene glycol having 2 to 12 carbon atoms is preferably used.

In the urethane resin, in addition to the diol components, a polyester oligomer having a hydroxyl group at a terminal (polyester oligomer having a terminal diol) may also be used as a suitable diol component.

From the perspective of reactivity and solubility in ethyl acetate, the molecular weight (number average molecular weight) of the polyester oligomer having a terminal diol is preferably 3,000 or less, and more preferably 800 or more to 2,000 or less.

In addition, the content of the polyester oligomer having a terminal diol is preferably 1 mol % or more to 10 mol % or less, and more preferably 3 mol % or more to 6 mol % or less, based on the monomers constituting the reaction product of the diol component and the diisocyanate component.

If the polyester oligomer having a terminal diol is in the above-described range, while obtaining suitable hardness as the shell and maintaining good fixability, a high affinity with the resin (a) can be obtained, and the higher adhesiveness between the core and the shell can be obtained.

It is preferred for forming good capsule-type toner particles that a polyester skeleton of the polyester oligomer having a terminal diol and a polyester skeleton of the resin (a) are the same. This relates to the affinity between the reaction product of the diol component and the diisocyanate component on the surface layer and the toner base particles (cores).

Further, the polyester oligomer having a terminal diol may have an ether bond modified with ethylene oxide, propylene oxide or the like.

The urethane resin may also include, in addition to the reaction product of the diol component and the diisocyanate component, a compound in which an amino compound and a reaction product of an isocyanate compound are connected with a urea bond.

Examples of the amino compound include diaminoethane, diaminopropane, diaminobutane, diaminohexane, piperazine, 2,5-dimethylpiperazine, and amino-3-aminomethyl-3,5,5-trimethyl cyclohexane (isophoronediamine, IPDA).

The urethane resin may also include, in addition to the above compounds, a reaction product of an isocyanate compound and a compound having a group on which a highly-reactive hydrogen is present, such as a carboxylic acid group, a cyano group and a thiol group.

The urethane resin may preferably include a carboxylic acid group, a sulfonic acid group, a carboxylate, or a sulfonate in its side chain. Such groups make it easy to form an aqueous dispersion during solution suspension, and are effective in forming a capsule-type structure stably without dissolving in the oil phase solvent. The urethane resin can be easily produced by introducing a carboxylic acid group, a sulfonic acid group, a carboxylate or a sulfonate into a side chain of the diol component or the diisocyanate component.

Examples of the diol component whose side chain a carboxylic acid group or a carboxylate is introduced into include dihydroxyl carboxylates such as dimethylol acetate, dimethylol propionate, dimethylol butanoate, dimethylol butyrate, and dimethylol pentanoate, and metal salts thereof.

On the other hand, examples of the diol component whose side chain a sulfonic acid group or a sulfonate is introduced into include sulfoisophthalate, N,N-bis(2-hydroxyethyl)-2-aminoethane sulfonate, and metal salts thereof.

The content of the diol component whose side chain a carboxylic acid group, a sulfonic acid group, a carboxylate or a sulfonate into is preferably 10 mol % or more to 50 mol % or less, and more preferably 20 mol % or more to 30 mol % or less, based on all of the monomers constituting the reaction product of the diol component and the diisocyanate component.

When using a vinyl resin, a preferred embodiment is to uniformly disperse a vinyl unit represented by the following general formula (1) in the surface layer. This is because the distribution of the vinyl unit represented by the following general formula (1) in the surface layer becomes uniform, and good triboelectric charge properties are exhibited. To uniformly disperse the above-described unit in the surface layer, polymerization may be carried out using a vinyl monomer which is produced by the unit.

Formula 1

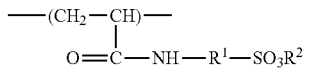

(1)

(In the formula, $R^1$ represents an aromatic or aliphatic hydrocarbon group, and $R^2$ represents a proton or an aliphatic hydrocarbon group.)

In the present invention, it is preferred that the vinyl unit represented by general formula (1) is concentrated in the toner surface vicinity. By doing so, better triboelectric charge properties are exhibited. Vinyl units represented by general formula (1) which can be suitably used in the present invention will now be described.

The vinyl unit represented by general formula (1) has an amide bond and a sulfonic acid ester in a polyethylene side chain, and thus expresses excellent triboelectric charge properties. It is preferred that the vinyl unit represented by general formula (1) easily mixes with the resin (b). In addition, it is preferred that the vinyl unit represented by general formula (1) can be uniformly dispersed in the toner surface layer.

The surface layer (B) may be formed by resin fine particles including the resin (b). The method for preparing these resin fine particles is not especially limited. Examples thereof may include an emulsion polymerization method, or a method involving dissolving the resin in a solvent, or melting the resin, to liquefy the resin, and suspending the liquid in an aqueous medium to form particles.

In the preparation of the resin fine particles, a known surfactant or dispersant can be used, or the resin forming the resin fine particles can be provided with self-emulsifying properties.

Examples of the solvent that can be used when the resin fine particles are prepared by dissolving the resin in a solvent include, but not especially limited to, hydrocarbon solvents such as ethyl acetate, xylene, and hexane, halogenated hydrocarbon solvents such as methylene chloride, chloroform and dichlorethane, ester solvents such as methyl acetate, ethyl acetate, butyl acetate and isopropyl acetate, ether solvents such as diethyl ether, ketone solvents such as acetone, methyl ethyl ketone, diisobutyl ketone, cyclohexanone and methylcyclohexane, and alcohol solvents such as methanol, ethanol and butanol.

A preferred method for preparing the resin fine particles is to use resin fine particles containing the reaction product of the diol component and the diisocyanate component as a dispersant. In this production method, a prepolymer having the diisocyanate component is produced, the prepolymer is rapidly dispersed in water, and subsequently, the diol component is added to the mixture to extend or crosslink the chain.

More specifically, a prepolymer having a diisocyanate component, and, as required, any other necessary components are dissolved or dispersed in a solvent having high solubility in water such as acetone or an alcohol from among the above-described solvents. The resultant mixture is then charged into water to rapidly disperse the prepolymer having a diisocyanate component, and then the diol component is added to produce a reaction product of the diol component and the diisocyanate component having the desired physical properties.

In order for the toner particles to form a capsule structure, the number average particle size of the resin fine particles including the resin (b) is preferably 100 nm or more to 300 nm or less.

If the number average particle size is in this range, good particle formation is possible. This makes it easier to form the capsule structure, and also easier to form a suitable coat thickness. More preferred is 120 nm or more to 250 nm or less. By using resin fine particles in this range, the coating properties of the resin (b) improve, and the stability during storage and during development is excellent.

A simple method for producing the toner particles used in the present invention will now be described. However, the present invention is not limited to this method.

The toner particles are preferably obtained by dispersing a dissolved product or a dispersion product (hereinafter referred to also as "oil phase") obtained by dispersing at least the resin (a) having a polyester as a main component, the colorant and the wax in an organic medium, in an aqueous medium in which the resin fine particles containing the resin (b) are dispersed (hereinafter referred to also as "aqueous phase"), removing the organic medium from the resultant dispersion, and drying the resultant product.

In the above-described system, the resin fine particles function as a dispersant when the dissolved product or the dispersion product (oil phase) is suspended in the aqueous phase. By preparing the toner particles by this method, capsule-type toner particles can be easily prepared without requiring an aggregation process on the toner surface.

In the preparation method of the oil phase, examples of the organic medium for dissolving the resin (a) and the like include hydrocarbon solvents such as xylene and hexane, ester solvents such as methyl acetate, ethyl acetate, butyl acetate, and isopropyl acetate, ether solvents such as diethyl ether, and ketone solvents such as acetone, methyl ethyl ketone, diisobutyl ketone, cyclohexanone, and methyl cyclohexane.

The resin (a) may be used in the form of a resin dispersion in which the resin is dissolved in the organic medium. In this case, the resin (a) can be blended in the organic medium as a resin component in the range of 40 to 60 mass %. This value depends on the viscosity and solubility of the resin, and is selected in view of facilitating production in the next step. In addition, it is preferred to heat the resin at a boiling point of the organic medium or lower when dissolving the resin, as this increases the solubility of the resin.

The wax and the colorant can also be in the form of a dispersion in the organic medium. More specifically, it is preferred to produce the respective wax and colorant dispersions by mechanically pulverizing the wax and the colorant beforehand by a wet method or a dry method, and then dispersing the pulverized wax and colorant in the organic medium.

The dispersibility of the wax and the colorant can be increased by adding a dispersant or a resin which suits each of the wax and the colorant. Such dispersants and resins vary depending on the wax, the colorant, the resin, and the organic solvent to be used, and thus may be used by selecting them appropriately. Especially, it is preferred to use the colorant after the colorant is dispersed beforehand in the organic medium together with the resin (a).

The oil phase can be prepared by blending the resin dispersion, the wax dispersion, the colorant dispersion, and the organic medium in desired amounts, and dispersing each component in the organic medium.

The colorant dispersion will now be described in more detail. First, the method for preparing the colorant dispersion will be further described with examples. To increase the dispersibility of the colorant beyond the ordinary, the following techniques may be used, for example.

(1) Wet Dispersion (Media Dispersion)

This method involves dispersing the colorant in a solvent in the presence of a dispersion medium.

For example, the colorant, the resin, other additives, and the organic solvent are mixed, and the resultant mixture is then dispersed using a disperser in the presence of the dispersion medium. The used dispersion medium is collected, and a colorant dispersion is obtained. As the disperser, an Attritor (Mitsui Miike Machinery Co., Ltd.) is used, for example. Examples of the dispersion medium include beads of alumina, zirconia, glass, and iron. Zirconia beads, which hardly cause media contamination, are preferred. In this case, the beads having a diameter of 2 to 5 mm have excellent dispersibility, and are thus preferred.

(2) Dry Kneading

The resin, the colorant, and other additives are melt-kneaded with a kneader and a roll-type disperser (dry type). The obtained melt-kneaded product of the resin and the colorant is pulverized, and then dissolved into the above-described organic medium, whereby the colorant dispersion is obtained.

(3) Wet Dispersion of Dry Melt-Kneaded Product

The above-described colorant dispersion is subjected to a wet dispersion using the above-described dispersion medium and disperser.

(4) Addition of Solvent During Production of Dry Melt-Kneaded Product

A solvent is added during the production of the dry melt-kneaded product. The temperature during the melt-kneading may be equal to or higher than the glass transition point (Tg) of the resin, and equal to or lower than the boiling point of the solvent. The solvent to be used is preferably a solvent capable of dissolving the resin, and preferably the solvent used in the above-described oil phase.

(5) Addition of Wax During Production of Dry Melt-Kneaded Product

A wax is added during production of the dry melt-kneaded product. The temperature during the melt-kneading may be equal to or higher than the glass transition point (Tg) of the resin, and equal to or lower than the boiling point of the solvent. The wax to be used may be a wax that can be dissolved into the above-described oil phase, and another wax having a comparatively higher melting point may also be used.

(6) Use of Resin Having High Affinity with Colorant

A resin having a high affinity with the colorant is used in the resin to be used in the production of the dry melt-kneaded product. Especially, it is preferred that the resin which disperses the colorant has a dialcohol component which is a polyester resin having bisphenol A as a main component. The acid value of the resin (a) is preferably 15 mg KOH/g or more to 30 mg KOH/g or less, and the weight average molecular weight Mw is preferably 30,000 or less.

Further, after mixing each dispersion, a fine dispersion process using ultrasonic waves is effective. In this case, agglomerations of the colorant in the dispersion after the oil phase preparation adjustment are loosened, which allows for even finer dispersions.

Examples of an ultrasonic oscillator for oscillating ultrasonic waves which may be used include an ultrasonic oscillation system which has a transducer for applying ultrasonic waves having a cylindrical structure, or an apparatus having an ultrasonic cleaning bath and an ultrasonic transducer attached to the bottom of the bath, which performs irradiation with ultrasonic waves in water.

The mechanism in which a pigment is more highly dispersed by the ultrasonic waves is not precisely understood. However, this mechanism is considered to be as a result of the following.

Oscillations of the solution itself, which is caused by irradiation with ultrasonic waves, is proportional to the frequency. The acceleration is very large, i.e., about 1,000 to 5,000 times as large as gravitational acceleration. Thus, when compared with the shearing action from a conventional stirring blade, the pigment can be highly dispersed more efficiently.

The aqueous medium may include water alone, or may also include water and a solvent which is miscible with water. Examples of solvents miscible with water include alcohols (methanol, isopropanol, ethylene glycol), dimethyl formamide, tetrahydrofuran, cellosolves (methyl cellosolve), and lower ketones (acetone, methyl ethyl ketone). In addition, a preferred method is to mix the organic medium used as the oil phase in an appropriate amount in the aqueous medium. This method has the effect of increasing droplet stability during granulation and facilitating suspension of the oil phase in the aqueous medium.

In the present invention, it is preferred to use the resin fine particles containing the urethane resin (b) dispersed in the aqueous medium. The resin fine particles containing the urethane resin (b) are blended in a desired amount according to stability of the oil phase in the next step and capsulation of the toner base particles. When the resin fine particles are used for forming the surface layer (B), the amount of the resin fine particles to be used is preferably 5.0 mass % or more to 15.0 mass % or less based on the toner base particles (A).

A known surfactant, dispersion stabilizer, water-soluble polymer or viscosity modifier can also be added to the aqueous medium.

Examples of the surfactant include an anionic surfactant, a cationic surfactant, an amphoteric surfactant, and a nonionic surfactant. These surfactants can be arbitrarily selected based on the polarity during formation of the toner particles.

Specific examples include anionic surfactants such as alkylbenzene sulfonate, α-olefin sulfonate, and ester phosphate; cationic surfactants including amine salt type surfactants such as alkyl amine salts, amino alcohol fatty acid derivatives, polyamine fatty acid derivatives, and imidazoline, and quaternary ammonium salt type surfactants such as alkyltrimethyl ammonium salts, dialkyldimethyl ammonium salts, alkyldimethylbenzyl ammonium salts, pyridinium salts, alkylisoquinolinium salts, and benzethonium chloride; nonionic surfactants such as fatty acid amide derivatives and polyalcohol derivatives; and amphoteric surfactants such as alanine, dodecyldi(aminoethyl)glycine, di(octylaminoethyl) glycine, and N-alkyl-N,N-dimethyl ammonium betaine.

In the present invention, a dispersion stabilizer is preferably used. The reason is as follows. An organic medium in which the resin (a) acting as the main component of the toner is dissolved has a high viscosity. The dispersion stabilizer surrounds oil droplets formed when finely dispersing the organic medium by a high shear force, thereby preventing the droplets from reagglomerating, and stabilizing the dispersion.

An inorganic dispersion stabilizer and an organic dispersion stabilizer can be used as the dispersion stabilizer. For an inorganic dispersion stabilizer, it is preferred that the stabilizer can be removed by an acid which has no affinity with the solvent, such as hydrochloric acid, because the toner particles are formed in a state in which the stabilizer adheres onto the surface of particles after dispersion. For example, calcium carbonate, calcium chloride, sodium hydrogen carbonate, potassium hydrogen carbonate, sodium hydroxide, potassium hydroxide, hydroxyapatite, or calcium triphosphate can be used.

The dispersion apparatus used when preparing the toner particles is not especially limited. A general-purpose apparatus can be used, such as a low-speed shearing type, high-speed shearing type, friction type, high-pressure jet type, or ultrasonic. A high-speed shearing type is preferable so that the dispersed particles can have a particle size of about 2 to 20 μm.

The stirring apparatus is not especially limited, as long as it has a rotating blade. A general-purpose emulsifier or disperser can be used as the above-described dispersion apparatus.

Examples thereof include continuous emulsifiers such as Cavitron (manufactured by EuroTec, LTD) and Fine Flow Mill (manufactured by Pacific Machinery & Engineering Co., Ltd.), and batch type or continuous duplex emulsification machines such as TK-homomixer (manufactured by Primix Corporation), Clear Mix (manufactured by M Technique Co., Ltd.) and Filmix (manufactured by Primix Corporation). When a high-speed shearing type disperser is used in the dispersion method, the number of revolutions of the machine, which is not especially limited, is typically about 1,000 to 30,000 rpm, and preferably 3,000 to 20,000 rpm.

In the case of a batch type disperser, the time period for dispersion in the dispersion method is typically 0.1 to 5 minutes. The temperature at the time of dispersion is typically 10 to 150° C. (under pressure), or preferably 10 to 100° C.

To remove the organic solvent from the obtained dispersion, the temperature of the entire system may be gradually increased so that the organic solvent in the droplets is completely evaporated and removed.

Alternatively, the dispersion may be sprayed into a dry atmosphere, so that the non-water-soluble organic solvent in the droplets is completely removed to form the toner particles, and at the same time the water in the dispersion is evaporated and removed.

In this case, as the dry atmosphere in which the dispersion liquid is sprayed, generally used is a gas obtained by heating air, nitrogen, carbon dioxide gas, or a combustion gas, and in particular, various air streams heated to temperatures equal to or higher than the boiling point of the solvent having the highest boiling point among the solvents to be used. The desired quality can be properly obtained even with a short-duration treatment using one of a spray dryer, a belt dryer, or a rotary kiln.

When the dispersion obtained by the above-described dispersion method exhibits a wide particle size distribution and is subjected to washing and drying treatments while the particle size distribution is maintained, the particle size distribution can be adjusted by classifying the toner particles to have a desired particle size distribution.

It is preferred to remove as much as possible of the dispersion stabilizer used in the above-described dispersion method from the resultant dispersion. The removal is more preferably performed simultaneously with the classification operation.

In the production method, after the organic solvent has been removed, a heating process may be further provided. By providing the heating process, the toner particle surfaces can be made smoother and the spherical degree of the toner particle surfaces can be adjusted.

In the classification operation, a portion of the fine particles can be removed in the liquid by a cyclone, a decanter, centrifugation or the like. Of course, the classification may be performed after obtaining a powder after drying, but classification in the liquid is preferred from the standpoint of efficiency.

Unnecessary fine particles or coarse particles obtained in the classification operation may be subjected to the dissolving process again and then used for forming particles. In this case, the fine particles or coarse particles may be in a wet state.

In the yellow toner according to the present invention, inorganic fine particles may be added as an external additive for aiding the fluidity, developability and charge performance of the toner.

The number average particle size of the primary particles of the inorganic fine particles is preferably 5 nm or more to 2 μm or less, and more preferably 5 nm or more to 500 nm or less. In addition, the inorganic fine particles have preferably a specific surface area of 20 $m^2/g$ or more to 500 $m^2/g$ or less according to a BET method.

The inorganic fine particles are used preferably in a ratio of 0.01 parts by mass or more to 5 parts by mass or less, or more preferably 0.01 parts by mass or more to 2.0 parts by mass or less, based on 100 parts by mass of the toner particles.

The inorganic fine particles may be of one type, or may be a combination of multiple types.

Specific examples of the inorganic fine particles include silica, alumina, titanium oxide, barium titanate, calcium titanate, strontium titanate, barium carbonate, calcium carbonate, silicon carbide, and silicon nitride.

To suppress deterioration in the fluidity and charge performance of the toner in high humidity, the inorganic fine particles are preferably subjected to treatment for increasing hydrophobicity using a surface treatment agent.

Preferred examples of the surface treatment agent include a silane coupling agent, a silylation agent, a silane coupling agent having an alkyl fluoride group, an organic titanate coupling agent, an aluminum coupling agent, a silicone oil, and a modified silicone oil.

Examples of the external additive (cleaning performance improver) for removing toner after transfer which remains on a photosensitive member or on a primary transfer medium include polymer fine particles produced by soap-free emulsion polymerization of a fatty acid metal salt (e.g., zinc stearate and calcium stearate), polymethyl methacrylate fine particles, polystyrene fine particles and the like.

It is preferred that the above polymer fine particles exhibit a relatively narrow particle size distribution, and have a volume average particle size of 0.01 to 1 μm.

The methods for measuring the various physical properties will now be described.

<Method for Measuring Light Absorbance Per Unit Concentration of Toner>

Method for Measuring $A(\text{chloroform})_{422}/C_{y2}$ 50 mg of toner was weighed, and added into 50 ml of chloroform by a pipette to dissolve. The resultant solution was diluted 5-fold with chloroform to obtain a 0.2 mg/ml solution of toner in chloroform. This solution of toner in chloroform was used as a sample for light absorbance measurement. In the measurement, the light absorbance of the solution was measured in the wavelength range of 350 nm to 800 nm using a quartz cell with a light path length of 10 mm, using the ultraviolet-visible spectrophotometer V-500V (manufactured by Jasco Corporation). For the yellow toner, the light absorbance at a wavelength of 422 nm was measured. Light absorbance per unit concentration (mg/ml) was calculated by dividing the obtained light absorbance by the concentration of the toner in the chloroform solution. The calculated value was defined as $A(\text{chloroform})_{422}/C_{y2}$.

Method for Measuring $A(\text{ethyl acetate})_{422}/C_{y1}$ 50 mg of toner was weighed into an ampule bottle, and added 50 ml of ethyl acetate by a pipette. The resultant solution was manually shaken 50 times to thoroughly mix the toner with the ethyl acetate. The resultant mixture was left standing for 12 hours, and then 10 mg of the supernatant was weighed. This supernatant was diluted 5-fold with ethyl acetate to obtain an ethyl acetate solution. This ethyl acetate solution was used as a sample for light absorbance measurement. In the measurement, the light absorbance of the dispersion was measured in the wavelength range of 350 nm to 800 nm using a quartz cell with a light path length of 10 mm, using the ultraviolet-visible spectrophotometer V-500V (manufactured by Jasco Corporation). For the yellow toner, the light absorbance at a wavelength of 422 nm was measured. Light absorbance per unit concentration (mg/ml) was calculated by dividing the obtained light absorbance by the concentration (0.2 mg/ml) of the toner with respect to the ethyl acetate. The calculated value was defined as $A(\text{ethyl acetate})_{422}/C_{y1}$.

<Method of Measuring Resin Acid Value>

An acid value is the number of milligrams of potassium hydroxide needed for the neutralization of an acid in 1 g of a sample. The acid value of a binder resin is measured in conformance with JIS K 0070-1966. Specifically, the measurement is performed as follows.

(1) Preparation of Reagent 1.0 g of phenolphthalein is dissolved in 90 ml of ethyl alcohol (95 vol %). Deionized water is charged into the solution so that the mixture has a volume of 100 ml, whereby a "phenolphthalein solution" is obtained.

7 g of potassium hydroxide (special grade chemical) is dissolved in 5 ml of water. Ethyl alcohol (95 vol %) is charged into the solution so that the mixture has a volume of 1 l. The mixture is place in an alkali-resistant container and left standing for 3 days so as not to be in contact with carbon dioxide gas. The mixture is then filtered to obtain a "potassium hydroxide solution". This potassium hydroxide solution is stored in an alkali-resistant container. The potassium hydroxide solution factor is determined by adding 25 ml of 0.1 mol/l hydrochloric acid into a conical flask, adding several drops of the above-described phenolphthalein solution, titrating with the potassium hydroxide solution, and then calculating the factor based on the amount of potassium hydroxide solution required for neutralization. The 0.1 mol/l hydrochloric acid was produced according to JIS K 8001-1998.

(2) Operation (A) Real Test 2.0 g of a pulverized sample of the binder resin is precisely weighed in a 200 ml conical flask, and 100 ml of a mixed solution of toluene and ethanol (2:1) is added to dissolve the sample over 5 hours. Subsequently, several drops of the phenolphthalein solution as an indicator are charged into the solution, and the solution is titrated using the potassium hydroxide solution. The end point of the titration is defined as when a faint red color of the indicator is exhibited for about 30 seconds.

(B) Blank Test

Titration is performed by the same operation as described above, except that no sample is used (i.e., only the mixed solution of toluene and ethanol (2:1) is used).

(3) The acid value is calculated by substituting the obtained results into the following equation.

$$A=[(B-C)\times f\times 5.61]/S$$

A: Acid value (mgKOH/g)

B: Added amount (ml) of the potassium hydroxide solution in the blank test

C: Added amount (ml) of the potassium hydroxide solution in the real test f: Factor of the potassium hydroxide solution S: Mass (g) of the sample <Method for Measuring Glass Transition Temperature Tg>

The method for measuring the Tg in the present invention was carried out under the following conditions using the DSC Q1000 (manufactured by TA Instruments).

(Measurement Conditions)

Modulation Mode

Rate of temperature increase: 0.5° C./min or 4.0° C./min

Modulation temperature width: ±1.0° C./min

Measurement start temperature: 25° C.

Measurement finish temperature: 130° C.

A new measurement sample was prepared when changing the rate of temperature increase. Temperature increase was only carried out once. The "Reversing Heat Flow" was plotted as ordinate to form a DSC curve. The onset value illustrated in FIG. 1 was defined as the Tg in the present invention.

<Method of Measuring Elastic Modulus G'(130)>

Measurement was performed using the viscoelasticity measuring apparatus (rheometer) ARES (manufactured by Rheometrics Scientific). The outline of the measurement, which is described in the ARES operating manuals 902-30004 (August, 1997) and 902-00153 (July, 1993) published by Rheometrics Scientific, is as follows.

Measuring jig: A serrated parallel plate having a diameter of 7.9 mm is used.

Measurement sample: A cylindrical sample of toner particles having a diameter of about 8 mm and a height of about 2 mm is molded using a pressure molding machine (15 kN is maintained at ordinary temperature for 1 minute). The 100 kN Press NT-100H (manufactured by NPa System Co., Ltd.) is used as the pressure molding machine.

The temperature of the serrated parallel plate is adjusted to 80° C. The cylindrical sample is melted by heating. Sawteeth are caused to bite into the molten sample, and a load is applied on the sample in a perpendicular direction so that an axial force does not exceed 30 (grams weight). As a result, the sample is adhered to the serrated parallel plate. A steel belt may be also used at this stage so that the diameter of the sample is equal to the diameter of the parallel plate. The serrated parallel plate and the cylindrical sample are slowly cooled to the measurement start temperature of 30.00° C. over 1 hour.

Measurement frequency: 6.28 radians/sec

Setting of measurement strain: An initial value is set to 0.1% and measurement is performed in an automatic measurement mode.

Elongation correction of sample: Adjustment in an automatic measurement mode.

Measurement temperature: Temperature is increased from 30° C. to 150° C. at a rate of 2° C./min.

Measurement interval: Viscoelasticity data is measured every 30 seconds, i.e., every 1° C.

Data is transferred to an RSI Orchesrator (control, data collection and analysis software program) (manufactured by Rheometrics Scientific) that operates on Windows 2000 manufactured by Microsoft Corporation via an interface.

Among the data, the value of the toner storage elasticity at 130° C. is read and defined as G'(130).

<Method of Measuring Weight-Average Particle Size (D4) and Number Average Particle Size (D1)>

The weight average particle size (D4) and the number average particle size (D1) of the toner were calculated as follows. As the measurement apparatus, the following was used: a precision particle size distribution measurement apparatus based on a pore electrical resistance method provided with a 100 μm aperture tube, the "Coulter Counter Multisizer 3", (registered trademark, manufactured by Beckman Coulter, Inc.). The setting of the measurement conditions and analysis of the measurement data was carried out using the dedicated software included with the apparatus, "Beckman Coulter Multisizer 3 Version 3.51" (manufactured by Beckman Coulter, Inc.). Measurement was performed with 25,000 effective measurement channels.

As the electrolyte solution to be used in the measurement, a solution prepared by dissolving sodium chloride (special grade chemical) in ion-exchange water to have a concentration of about 1 mass %, for example, an "Isoton II" (manufactured by Beckman Coulter, Inc.) can be used.

The dedicated software was set in the following manner prior to carrying out measurement and analysis.

In the "change standard operation method (SOM)" screen of the dedicated software, the total count number of control modes is set to 50,000 particles, the number of times of measurement is set to 1, and a value obtained by using "standard particles 10.0 μm" (manufactured by Beckman Coulter, Inc.) is set as a Kd value. A threshold and a noise level are automatically set by pressing a threshold/noise level measurement button. In addition, the current is set to 1,600 μA, gain is set to 2, the electrolyte solution is set to Isoton II, and a check mark is placed in "flush aperture tube after measurement" check box.

In the "setting for conversion from pulse to particle size" screen of the dedicated software, a bin interval is set to logarithmic particle size, the number of particle size bins is set to 256, and the particle size range is set to the range of 2 μm to 60 μm.

The specific measurement method is as follows.

(1) About 200 ml of the electrolyte solution is charged into a 250 ml round-bottom glass beaker designed for the Multisizer 3. The beaker is set in a sample stand, and the electrolyte solution in the beaker is stirred with a stirring rod at 24 rotations/sec in a counterclockwise direction. Then, dirt and air bubbles in the aperture tube are removed by the "aperture flush" function of the analysis software.

(2) About 30 ml of the electrolyte solution is charged into a 100 ml flat-bottom glass beaker. Then, the beaker is charged with about 0.3 ml of a diluted solution, as a dispersant, prepared by diluting "Contaminon N" (a 10 mass % aqueous solution of a neutral detergent for washing a precision measuring device, containing a nonionic surfactant, a cationic surfactant, and an organic builder, and having a pH of 7, which is manufactured by Wako Pure Chemical Industries, Ltd.) three-fold in terms of mass with ion-exchange water.

(3) About 3.3 l of ion-exchange water is charged into the water tank of an ultrasonic disperser "Ultrasonic Dispersion System Tetra 150" (manufactured by Nikkaki Bios, co. ltd.) in which two oscillators having an oscillating frequency of 50 kHz are installed in such a state that their phases are shifted from each other by 180°, and which has an electrical output of 120 W. About 2 ml of the Contaminon N is added into the water tank.

(4) The beaker in the above section (2) is set in the beaker fixing hole of the ultrasonic disperser, and the ultrasonic disperser is operated. Then, the height position of the beaker is adjusted so that the liquid level of the electrolyte solution in the beaker can resonate to the fullest extent possible.

(5) About 10 mg of the toner is gradually charged and dispersed into the electrolyte solution in the beaker from the above section (4) while irradiating the electrolyte solution with ultrasonic waves. Then, the ultrasonic dispersion treatment is continued for an additional 60 seconds. During the ultrasonic dispersion, the temperature of the water in the water tank is appropriately adjusted so as to be in the range of 10° C. or more to 40° C. or less.

(6) The electrolyte solution from the above section (5), in which the toner has been dispersed, is added dropwise with a pipette into the round-bottom beaker from the above section (1) placed in the sample stand. Then, the measurement concentration is adjusted to about 5%. Measurement is performed until the 50,000 particles are measured.

(7) The measurement data is analyzed with the dedicated software included with the apparatus, and the weight average particle size (D4) and the number average particle size (D1) are calculated. The "average size" on the "analysis/volume statistics (arithmetic average)" screen when the dedicated software is set to graph/vol % is the weight average particle size (D4), and the "average size" on the "analysis/volume statistics (arithmetic average)" screen when the dedicated software is set to graph/number % is the number average particle size (D1).

<Methods for Measuring Toner Average Circularity and Toner Fine Powder Amount>

The average circularity of the toner was measured using a flow-type particle image analyzer "FPIA-3000" (manufactured by Sysmex Corporation) under the same measurement and analysis conditions as in the calibration operation.

Specifically, measurement was carried out by charging an appropriate amount of a surfactant, preferably sodium dodecylbenzene sulfonate, as a dispersant, into 20 ml of deionized water, and then adding 0.02 g of a measurement sample to the mixture. The resultant mixture was then subjected to dispersion treatment with a desktop ultrasonic cleaning and dispersing machine having an oscillatory frequency of 50 kHz and an electrical output of 150 W (e.g., "VS-150" (manufactured by Velvo-Clear)) for 2 minutes, whereby a dispersion for measurement was obtained. In this case, the dispersion was appropriately cooled so as to have a temperature of 10° C. or more to 40° C. or less.

The flow-type particle image analyzer mounted with a standard objective lens (10 magnifications) was used for measurement, and a particle sheath "PSE-900A" (manufactured by Sysmex Corporation) was used as a sheath liquid. The dispersion liquid prepared according to the above procedure was introduced into the flow-type particle image analyzer, and 3,000 toner particles were measured in a total count mode in an HPF measurement mode. The binarized threshold during particle analysis was set to 85%. Analyzed particle sizes are limited to a circle-equivalent diameter of 2.00 μm or more to 200.00 μm or less to determine the average circularity of the toner particles.

Before starting the measurement, automatic focusing is performed using standard latex particles (obtained by diluting, for example, "5100A" manufactured by Duke Scientific Corporation with ion-exchange water). After that, focusing is preferably performed every two hours from the start of measurement.

In the examples, a flow-type particle image analyzer was used which had undergone calibration operation by Sysmex Corporation and had received a calibration certificate issued by Sysmex Corporation. Measurement was performed under the same measurement and analysis conditions as those at the time of receiving the calibration certificate, except that the particle sizes to be analyzed were limited to a circle-equivalent diameter of 2.00 μm or more to 200.00 μm or less.

As for the fine powder amount of the toner, the particle sizes to be analyzed were measured in the same manner as in the measurement of the average circularity in the range of 0.60 μm or more to 200.00 μm or less. The number frequency of particles in the range of 0.60 μm or more to 200.00 μm or less was determined, and the ratio of the particles in the range of 0.60 μm or more to 200.00 μm or less to particles in the whole range was determined. This ratio was defined as the fine powder amount of the toner.

<Methods for Measuring Molecular Weight Distribution, Peak Molecular Weight, and Number Average Molecular Weight of Resin by Gel Permeation Chromatography (GPC)>

The molecular weight distribution, the peak molecular weight, and the number average molecular weight of the resin were measured by gel permeation chromatography (GPC) in which the tetrahydrofuran (THF)-soluble matter of the resin was measured using THF as a solvent. Measurement conditions were as follows.

(1) Production of Measurement Sample

The resin (sample) and THF were mixed in a concentration of about 0.5 to 5 mg/ml (e.g., about 5 mg/ml), and the resultant mixture was left to stand at room temperature for several hours (e.g., 5 to 6 hours). Subsequently, the mixture was thoroughly shaken to mix the THF and the sample to such an extent that agglomerations of the sample disappeared. Further, the mixture was left to stand at room temperature for 12 hours or more (e.g., 24 hours). At this stage, the time from the start of mixing the sample and the THF to the finish of leaving the mixture to stand was set to 24 hours or more.

Then, a filtrate was obtained by passing the mixture through a sample treatment filter (pore size of 0.45 to 0.5 μm, Maishori-Disk H-25-2 (manufactured by Tosoh Corporation), or Ekikuro-Disk 25CR (manufactured by Gelman Science Japan) are preferably used). This filtrate was used as the GPC sample.

(2) Sample Measurement

A column was stabilized in a heat chamber at 40° C. THF as a solvent was flowed into the column at this temperature at a flow rate of 1 ml/min, and about 50 to 200 μl of a THF sample solution of a resin having a sample concentration adjusted to 0.5 to 5 mg/ml was injected for measurement.

When measuring the molecular weight of the sample, the molecular weight distribution of the sample was calculated from the relationship between a logarithmic value of an analytical curve formed using several types of monodisperse polystyrene standard samples and a count number.

As the standard polystyrene samples for preparing the analytical curve, samples manufactured by Pressure Chemical Co., or by Tosoh Corporation having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2.0\times10^6$, or $4.48\times10^6$ were used. A RI (refractive index) detector was used as the detector.

As described below, a combination of multiple commercially-available polystyrene gel columns was used in order to accurately measure the molecular weight region of $1\times10^2$ to $2\times10^6$. The GPC measurement conditions in the present invention are as follows.

(GPC Measurement Conditions)

Apparatus: LC-GPC 150C (manufactured by Waters Corporation)

Columns: A series of seven columns, KF801, 802, 803, 804, 805, 806, and 807 (manufactured by Showa Denko K.K.)

Column temperature: 40° C.

Mobile phase: THF (tetrahydrofuran)

<Method for Measuring Particle Size of Resin Fine Particles>

The particle size of the resin fine particles was measured using a microtrack particle size distribution measurement apparatus HRA (X-100) (manufactured by Nikkiso Co., Ltd.) with a range set to 0.001 μm to 10 μm. The particle size was measured as the number average particle size. Water was selected as the dilution solvent.

<Method of Measuring Melting Point of Wax>

The melting point of the wax was measured using a differential scanning calorimeter (DSC), "Q1000" (manufactured by TA Instruments), according to ASTM D3418-82.

The melting points of indium and zinc were used for temperature correction of an apparatus detector. The melting heat of indium was used for calorimetric correction.

Specifically, about 10 mg of a sample was precisely weighed and charged into an aluminum pan. Measurement was performed in the measurement temperature range of 30 to 200° C. at a rate of temperature increase of 10° C./min with the use of an empty aluminum pan as reference. In the measurement, the temperature was increased to 200° C. once, subsequently decreased to 30° C., and then increased again. In the second temperature increase stage, the temperature indicating a maximum endothermic peak of the DSC curve in the temperature range of 30 to 200° C. was defined as the melting point of the wax. When there are two or more peaks, the maximum endothermic peak is the peak showing the largest endotherm.

EXAMPLES

The present invention will now be described in more detail by way of working examples. However, the present invention is in no way limited to these examples.

<Preparation of Resin Fine Particle Dispersion 1>

The following materials were charged into a reaction apparatus equipped with a stirrer and a thermometer while introducing nitrogen.

| | |
|---|---|
| Polyesterdiol (polycondensation product of 1,4-butanediol and adipic acid, trade name "Sanester 4610", manufactured by Sanyo Chemical Industries, Ltd.) | 66 parts by mass |
| 1,9-Nonanediol | 25 parts by mass |
| 2,2-Dimethylolpropanoic acid | 43 parts by mass |
| Sodium 3-(2,3-dihydroxypropoxy)-1-propanesulfonate | 6 parts by mass |
| Isophorone diisocyanate | 110 parts by mass |
| Triethylamine | 3 parts by mass |
| Acetone | 250 parts by mass |

The resultant mixture was heated to 50° C., and urethanization reaction was carried out over 15 hours to prepare a solution of a urethane resin with terminal hydroxyl groups. The isocyanate group content after the urethanization reaction finished was 0%. The solution was cooled to 40° C. To neutralize part of the carboxyl groups of the 2,2-dimethylolpropanoic acid, 20 parts by mass of triethylamine was added and mixed into the solution, whereby a reaction mixture was obtained.

This reaction mixture was poured into 1,500 parts by mass of water while stirring with a homomixer and was emulsified, thereby obtaining a dispersion containing resin fine particles 1, which were in a polyurethane resin emulsion. This dispersion was adjusted to have a solid content of 20 mass % to prepare resin fine particle dispersion 1.

<Preparation of Resin Fine Particle Dispersion 2>

Resin fine particle dispersion 2 having resin fine particles 2 was obtained in the same manner as in the resin fine particle dispersion 1, except that in the step of producing the resin fine particles 1, the added amount of isophorone diisocyanate was changed to 70 parts by mass, and 35 parts by mass of hexane diisocyanate was further added.

<Preparation of Resin Fine Particle Dispersion 3>

Resin fine particle dispersion 3 having resin fine particles 3 was obtained in the same manner as in the resin fine particle dispersion 1, except that in the step of producing the resin fine particles 1, the added amount of isophorone diisocyanate was changed to 100 parts by mass, and 10 parts by mass of xylene diisocyanate was further added.

<Preparation of Resin Fine Particle Dispersion 4>

Resin fine particle dispersion 4 having resin fine particles 4 was obtained in the same manner as in the resin fine particle dispersion 1, except that in the step of producing the resin fine particles 1, the added amount of isophorone diisocyanate was changed to 80 parts by mass, and 25 parts by mass of hexane diisocyanate was further added.

<Preparation of Resin Fine Particle Dispersion 5>

Resin fine particle dispersion 5 having resin fine particles 5 was obtained in the same manner as in the resin fine particle dispersion 1, except that in the step of producing the resin fine particles 1, the added amount of isophorone diisocyanate was changed to 105 parts by mass, and 5 parts by mass of xylene diisocyanate was further added.

<Preparation of Resin Fine Particle Dispersion 6>

An autoclave equipped with a thermometer and a stirrer was charged with the following.

| | |
|---|---|
| Dimethyl terephthalate | 116 parts by mass |
| Dimethyl isophthalate | 66 parts by mass |
| 5-Sodium sulfoisophthalate methylester | 3 parts by mass |
| Trimellitic anhydride | 5 parts by mass |
| Propylene glycol | 150 parts by mass |
| Tetrabutoxy titanate | 0.1 parts by mass |

The resultant mixture was heated at 200° C. for 120 minutes to carry out ester exchange reaction. Next, the temperature of the reaction system was increased to 220° C., and the reaction was continued for 60 minutes with the pressure of the system set to 1 to 10 mmHg to thereby obtain a polyester resin.

40 parts by mass of the obtained polyester resin was dissolved in 15 parts by mass of methyl ethyl ketone and 10 parts by mass of tetrahydrofuran at 75° C. Then, 60 parts by mass of water was added at 75° C. while stirring, and the solvent was removed under reduced pressure. Ion-exchanged water was then added to the resultant mixture, whereby resin fine particle dispersion 6 having resin fine particles 6 and a solid content of 20 mass % was obtained.

<Preparation of Resin Fine Particle Dispersion 7>

A polymerizable monomer composition was prepared by dissolving the following in a reaction vessel equipped with a cooling pipe, a nitrogen introduction pipe, and a stirrer.

| | |
|---|---|
| Methyl acrylamide-2-methylpropane sulfonate | 11 parts by mass |
| Styrene | 60 parts by mass |
| Butyl acrylate | 29 parts by mass |
| Acetone | 30 parts by mass |
| 2,2'-Azobis(2,4-dimethylvaleronitrile) | 2 parts by mass |

Polymerization was carried out for 8 hours at 60° C., and the temperature of the system was increased to 150° C. The system was cooled to ordinary temperature, and then the product was diluted with acetone to obtain an acetone solution with a solid content of 76 mass %.

100 Parts by mass of this acetone solution (solid content of 76 mass %) was added dropwise to 200 parts by mass of ion-exchange water while stirring to form an emulsion. The acetone was then removed under a reduced pressure of 100 mmHg by a rotary evaporator. Ion-exchange water was added to dilute the solution to have a solid content of 20 mass %, whereby resin fine particle dispersion 7 having resin fine particles 7 was obtained.

TABLE 1

| | Resin Fine Particles | | Glass Transition Temperature Tg (° C.) | Number Average Particle Size (nm) in the Dispersion |
|---|---|---|---|---|
| Resin Fine Particle Dispersion-1 | Urethane-1 | b-1 | 68.4 | 110 |

TABLE 1-continued

| | Resin Fine Particles | | Glass Transition Temperature Tg (° C.) | Number Average Particle Size (nm) in the Dispersion |
|---|---|---|---|---|
| Resin Fine Particle Dispersion-2 | Urethane-2 | b-2 | 53.2 | 160 |
| Resin Fine Particle Dispersion-3 | Urethane-3 | b-3 | 86.5 | 90 |
| Resin Fine Particle Dispersion-4 | Urethane-4 | b-4 | 56.3 | 70 |
| Resin Fine Particle Dispersion-5 | Urethane-5 | b-5 | 78.3 | 90 |
| Resin Fine Particle Dispersion-6 | Polyester | b-6 | 63.1 | 240 |
| Resin Fine Particle Dispersion-7 | St-Ac | b-7 | 78.3 | 80 |

<Preparation of Polyester 1>

| | |
|---|---|
| Polyoxypropylene(2.2)-2,2-bis(4-hydroxyphenyl)propane | 30 parts by mass |
| Polyoxyethylene(2.2)-2,2-bis(4-hydroxyphenyl)propane | 33 parts by mass |
| Terephthalic acid | 21 parts by mass |
| Trimellitic anhydride | 1 part by mass |
| Fumaric acid | 3 parts by mass |
| Dodecenyl succinic acid | 12 parts by mass |
| Dibutyltin oxide | 0.1 parts by mass |

The above raw materials were charged into a four-necked, 4-L glass flask. A thermometer, stirring rod, condenser, and nitrogen introduction pipe were attached to the flask, and the flask was then put in a mantle heater. Under a nitrogen atmosphere, the mixture was reacted at 210° C. for 3.0 hours, whereby polyester 1 was obtained. Polyester 1 had a Tg of 46° C., an acid value of 18 mg KOH/g, and a hydroxyl group value of 25 mg KOH/g.

<Preparation of Polyester 2>

Polyester 2 was obtained in the same manner as in polyester 1, except that the reaction was carried out under a nitrogen atmosphere at 200° C. for 4.0 hours. Polyester 2 had a Tg of 38° C., an acid value of 21 mg KOH/g, and a hydroxyl group value of 27 mg KOH/g.

<Preparation of Polyester 3>

Polyester 3 was obtained in the same manner as in polyester 1, except that the reaction was carried out under a nitrogen atmosphere at 215° C. for 5.0 hours. Polyester 3 had a Tg of 62° C., and an acid value of 6 mg KOH/g.

<Preparation of Polyester 4>

Polyester 4 was obtained in the same manner as in polyester 1, except that the reaction was carried out under a nitrogen atmosphere at 200° C. for 4.5 hours.

Polyester 4 had a Tg of 41° C., an acid value of 20 mg KOH/g, and a hydroxyl group value of 26 mg KOH/g.

<Preparation of Polyester 5>

The following materials were charged into a reaction vessel equipped with a cooling pipe, a nitrogen introduction pipe, and a stirrer.

| | |
|---|---|
| 1,2-Propanediol | 799 parts by mass |
| Dimethyl terephthalate | 815 parts by mass |
| 1,5-Pentanedioic acid | 238 parts by mass |
| Tetrabutoxy titanate (condensation catalyst) | 3 parts by mass |

The resultant mixture was reacted at 180° C. for 8 hours in a stream of nitrogen while generated methanol was distilled off. Next, the temperature of the resultant product was increased gradually to 230° C. The product was then reacted for 4 hours in a stream of nitrogen, while generated propylene glycol and water were distilled off. The resultant product was further reacted for 1 hour under a reduced pressure of 20 mmHg and then cooled to 180° C. 173 Parts by mass of trimellitic anhydride was added to the product, and the resultant mixture was reacted for 2 hours under sealing at normal pressure, followed by reacting at 220° C. at normal pressure. The resultant product was removed at the point when the softening point became 170° C. After cooling to room temperature, the removed resin was pulverized into particles, whereby polyester 4, which was a non-linear polyester resin, was obtained. Polyester 4 had a Tg of 58° C., an acid value of 4 mg KOH/g, and a hydroxyl group value of 20 mg KOH/g.

<Preparation of Polyester 6>

Polyester 6 was obtained in the same manner as in polyester 1, except that the reaction was carried out under a nitrogen atmosphere at 220° C. for 4.5 hours. Polyester 6 had a Tg of 42° C., an acid value of 19.5 mg KOH/g, and a hydroxyl group value of 25.5 mg KOH/g.

<Preparation of Polyester 7>

Polyester 7 was obtained in the same manner as polyester 1, except that the reaction was carried out under a nitrogen atmosphere at 215° C. for 4.5 hours. Polyester 7 had a Tg of 56° C., an acid value of 9 mg KOH/g, and a hydroxyl group value of 17 mg KOH/g.

<Preparation of Polyester 8>

The same materials as used in the preparation of Polyester 1 were charged into a four-necked, 4-L glass flask. A thermometer, stirring rod, condenser, and nitrogen introduction pipe were attached to the flask, and the flask was then put in a mantle heater. Under a nitrogen atmosphere, the mixture was reacted at 210° C. for 3.0 hours, and then 0.5 parts by mass of trimellitic anhydride was added. The resultant mixture was then cooled to obtain polyester 8. Polyester 1 had a Tg of 52° C., an acid value of 28 mg KOH/g, and a hydroxyl group value of 14 mg KOH/g.

<Preparation of Polyester 9>

The same materials as used in the preparation of Polyester 1 were charged into a four-necked, 4-L glass flask. A thermometer, stirring rod, condenser, and nitrogen introduction pipe were attached to the flask, and the flask was then put in a mantle heater. Under a nitrogen atmosphere, the mixture was reacted at 210° C. for 3.0 hours, and then 1.0 parts by mass of trimellitic anhydride was added. The resultant mixture was then cooled to obtain polyester 9. Polyester 9 had a Tg of 54° C., an acid value of 34 mg KOH/g, and a hydroxyl group value of 10 mg KOH/g.

<Preparation of Polyester Resin Solutions>

Ethyl acetate was charged into a sealable vessel equipped with a stirring blade. Under stirring at 100 rpm, each of the polyesters 1 to 5 and 8 was added, and stirred for 3 days at room temperature, whereby polyester resin solutions 1 to 6 were prepared. The resin content (mass %) was 50 mass % for each solution.

<Preparation of Wax Dispersion 1>

| | |
|---|---|
| Carnauba wax (melting point 81° C.) | 20 parts by mass |
| Ethyl acetate | 80 parts by mass |

The above materials were charged into a glass beaker equipped with a stirring blade (manufactured by Iwaki Co., Ltd.), and the system was heated to 70° C. to dissolve carnauba wax in the ethyl acetate.

Next, the system was gradually cooled to 25° C. over 3 hours while gently stirring at 50 rpm, whereby a milky-white liquid was obtained.

This solution and 20 parts by mass of 1-mm glass beads were charged into a heat-resistant vessel, and the resultant mixture was dispersed with a paint shaker (manufactured by Toyo Seiki Seisaku-sho, Ltd.) for 3 hours, whereby wax dispersion 1 was obtained.

The wax particle size in wax dispersion 1 was measured with a microtrack particle size distribution measurement apparatus HRA (X-100) (manufactured by Nikkiso Co., Ltd.), and the number average particle size was 0.15 μm.

<Preparation of Wax Dispersion 2>

| | |
|---|---|
| Stearyl stearate (melting point 67° C.) | 16 parts by mass |
| Nitrile group-containing styrene acrylic resin (styrene 65 parts by mass, n-butylacrylate 35 parts by mass, acrylonitrile 10 parts by mass, peak molecular weight 8,500) | 8 parts by mass |
| Ethyl acetate | 76 parts by mass |

The above materials were charged into a glass beaker equipped with a stirring blade (manufactured by Iwaki Co., Ltd.), and the system was heated to 65° C. to dissolve the stearyl stearate in the ethyl acetate.

Next, wax dispersion 2 was prepared through the same process as in wax dispersion 1. The wax particle size in wax dispersion 2 was measured with a microtrack particle size distribution measurement apparatus HRA (X-100) (manufactured by Nikkiso Co., Ltd.), and the number average particle size was 0.12 μm.

<Preparation of Wax Dispersion 3>

| | |
|---|---|
| Trimethylolpropane tribehenate (melting point 58° C.) | 16 parts by mass |
| Additive (nitrile group-containing styrene acrylic resin (styrene 65 parts by mass, n-butylacrylate 35 parts by mass, acrylonitrile 10 parts by mass), peak molecular weight 8,500) | 8 parts by mass |
| Ethyl acetate | 76 parts by mass |

The above materials were charged into a glass beaker equipped with a stirring blade (manufactured by Iwaki Co., Ltd.), and the system was heated to 60° C. to dissolve the trimethylolpropane tribehenate in the ethyl acetate.

Next, wax dispersion 3 was obtained through the same process as in wax dispersion 1. The wax particle size in wax dispersion 3 was measured with a microtrack particle size distribution measurement apparatus HRA (X-100) (manufactured by Nikkiso Co., Ltd.), and the number average particle size was 0.18 μm.

<Preparation of Colorant Dispersion Y1>

| | |
|---|---|
| C.I. Pigment Yellow 74 | 100 parts by mass |
| Polyester 1 | 100 parts by mass |
| Ethyl acetate | 300 parts by mass |
| Glass beads (1 mm) | 400 parts by mass |

The above materials were charged into a heat resistant glass vessel and then dispersed for 5 hours by a paint shaker. The glass beads were removed by a nylon mesh to obtain colorant dispersion Y1.

<Preparation of Colorant Dispersion Y2>

| | |
|---|---|
| C.I. Pigment Yellow 74 | 100 parts by mass |
| Ethyl acetate | 150 parts by mass |
| Glass beads (1 mm) | 200 parts by mass |

The above materials were charged into a heat resistant glass vessel and then dispersed for 5 hours by a paint shaker. The glass beads were removed by a nylon mesh to obtain colorant dispersion Y2.

<Preparation of Colorant Dispersions Y3 to Y8>

Colorant dispersions Y3 to Y8 were obtained in the same manner as in the preparation of colorant dispersion Y1, except that the resin used was changed to polyester 2 to 7.

<Preparation of Colorant Dispersion Y9>

| | |
|---|---|
| C.I. Pigment Yellow 74 | 100 parts by mass |
| Polyester 1 | 150 parts by mass |

The above materials were charged into a kneading-type mixer, and while mixing the materials, the temperature was increased without applying pressure. The temperature was increased to 130° C. The mixture was then heated and melt-kneaded for about 60 minutes to disperse the yellow pigment in the resin. The mixture was then cooled to obtain a kneaded product.

Next, the kneaded product was coarsely pulverized with a hammer, and then mixed with ethyl acetate so that the solid content was 50 mass %. Subsequently, using a disper, the mixture was stirred at 8,000 rpm for 10 minutes to prepare colorant dispersion Y9.

<Preparation of Colorant Dispersion Y10>

| | |
|---|---|
| C.I. Pigment Yellow 74 | 100 parts by mass |
| Polyester 1 | 150 parts by mass |

The above materials were charged into a kneader-type mixer, and while mixing the materials, the temperature was increased without applying pressure. The temperature was increased to 130° C. The mixture was then heated and melt-kneaded for about 60 minutes to disperse the yellow pigment in the resin. The mixture was then cooled to obtain a kneaded product. Next, the kneaded product was coarsely pulverized with a hammer to prepare a pulverized product.

| | |
|---|---|
| Kneaded product | 250 parts by mass |
| Ethyl acetate | 250 parts by mass |
| Glass beads (1 mm) | 400 parts by mass |

The above materials were charged into a heat resistant glass vessel and then dispersed for 5 hours by a paint shaker. The glass beads were removed by a nylon mesh to prepare colorant dispersion Y10.

<Preparation of Colorant Dispersions Y11 and Y12>

Colorant dispersions Y11 and Y12 were obtained in the same manner as in the production of colorant dispersion Y1, except that the used resin was changed to polyester 8 or polyester 9.

<Preparation of Colorant Dispersion Y13>

| | |
|---|---|
| C.I. Pigment Yellow 155 | 100 parts by mass |
| Polyester 1 | 100 parts by mass |
| Ethyl acetate | 300 parts by mass |
| Glass beads (1 mm) | 400 parts by mass |

The above-described materials were charged into a heat resistant glass vessel and then dispersed for 5 hours by a paint shaker. The glass beads were removed by a nylon mesh to prepare colorant dispersion Y13.

<Carrier Preparation Example>

A magnetite powder having a number average particle size of 0.25 μm and a hematite powder having a number average particle size of 0.60 μm were each charged with 4.0 mass % of a silane coupling agent 3-(2-aminoethylaminopropyl)trimethoxysilane. The resultant mixtures were mixed and stirred at high speed in a vessel at 100° C. or more, and the fine particles of each of the mixtures were subjected to hydrophobic treatment.

| | |
|---|---|
| Phenol | 10 parts by mass |
| Formaldehyde solution (formaldehyde 40%, methanol 10%, water 50%) | 6 parts by mass |
| Magnetite subjected to hydrophobic treatment | 63 parts by mass |
| Hematite subjected to hydrophobic treatment | 21 parts by mass |

The above materials, 5 parts by mass of 28% ammonia water and 10 parts by mass of water were charged into a flask, and were heated to 85° C. for 30 minutes under stirring and mixing and held. The resultant mixture was then cured by carrying out a polymerization reaction for 3 hours. Thereafter, the reaction system was cooled to 30° C., and water was further added thereto. Then, the supernatant liquid was removed, and the sediment was washed with water and air-dried. Subsequently, the resultant product was dried at 60° C. under reduced pressure (5 mmHg or less) to prepare spherical magnetic resin particles with magnetic particles dispersed therein.

A copolymer of methyl methacrylate and methyl methacrylate having a perfluoroalkyl group (m=7) (copolymerization ratio 8:1, weight average molecular weight 45,000) was used as a coating resin. 10 Parts by mass of melamine particles having a number average particle size of 290 nm and 6 parts by mass of carbon particles having a resistivity of $1\times10^{-2}$ Ω·cm and a number average particle size of 30 nm were added to 100 parts by mass of the coating resin. The resultant mixture was dispersed by an ultrasonic disperser for 30 minutes. Further, a coating solution in a mixed solvent of methyl ethyl ketone and toluene was prepared so that the coating resin was 2.5 parts by mass based on 100 parts by mass of the carrier core (solution concentration 10 mass %).

While continuously applying a shear stress to this coating fluid, the solvents were evaporated off at 70° C. to coat the resin on the surface of the magnetic resin particles. The thus resin-coated magnetic carrier particles were heat treated while stirring at 100° C. for 2 hours, cooled, and then disintegrated. Subsequently, the resultant particles were classified using a 200 mesh (aperture 75 μm) sieve to prepare a carrier having a number average particle size of 33 μm, a true specific gravity of 3.53 g/cm$^3$, an apparent specific gravity of 1.84 g/cm$^3$ and a magnetization intensity of 42 Am$^2$/kg.

Example 1

Preparation of Liquid Toner Composition 1

| | |
|---|---|
| Wax dispersion 1 (carnuba wax solid content: 20%) | 50 parts by mass |
| Colorant dispersion Y1 (pigment solid content: 20%, resin solid content: 20%) | 70 parts by mass |
| Polyester resin solution 1 (resin solid content: 50%) | 124 parts by mass |
| Triethylamine | 0.5 parts by mass |
| Ethyl acetate | 5.5 parts by mass |

The above solutions were charged into a vessel, and stirred and dispersed at 1,500 rpm for 10 minutes with a Homo Disper (manufactured by Primix Corporation), and further dispersed for 30 minutes at ordinary temperature with an ultrasonic dispersing device to prepare oil phase 1.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 210.5 parts by mass |
| Resin fine particle dispersion 1 (8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

(Emulsifying and Desolvating Steps)

The oil phase was charged into the aqueous phase, and the resultant mixture was stirred continuously for 1 minute by a TK-homomixer at 8,000 rpm or less, whereby the oil phase 1 was suspended.

Next, a stirring blade was set in the vessel, and desolvation was carried out over 5 in such a state that the temperature in the system was raised to 50° C. while stirring at 200 rpm and the pressure was reduced to 500 mmHg, whereby an aqueous dispersion of toner particles was obtained.

(Washing and Drying Steps)

Next, the above aqueous dispersion of toner particles was filtered, and the resultant residue was re-slurried into 500 parts by mass of ion-exchange water. Then, while stirring the system, hydrochloric acid was added to the system until the pH was 4. The mixture was then stirred for 5 minutes. A series of operations was repeated three times in which the above slurry was filtered again, 200 parts by mass of ion-exchange water was added to the residue, and the mixture was stirred for 5 minutes. As a result, triethylamine remaining in the system was removed, whereby a filter cake of the toner particles was obtained.

This filter cake was dried with a warm air dryer at 45° C. for 3 days and sieved with a mesh having an aperture of 75 μm to obtain toner particles 1.

(Preparation of Toner and Two-Component Developer)

First, 0.9 parts by mass of an anatase titanium oxide fine powder (BET specific surface area 80 m$^2$/g, number average particle size (D1) 15 nm, treated with 12 mass % of isobutyltrimethoxysilane) was externally added to 100 parts by mass of the above toner particles 1 by means of a Henschel mixer. Then, 1.2 parts by mass of oil-treated silica fine particles (BET specific surface area 95 m$^2$/g, treated with 15 mass % of silicone oil) and 1.5 parts by mass of the above-described inorganic fine particles (Sol-gel silica fine particles: BET specific surface area 24 m$^2$/g, number average particle size (D1) 110 nm) were mixed by the use of the Henschel mixer FM-10B (manufactured by Mitsui Miike Machinery Co., Ltd.) to thereby obtain toner 1. The formulation of the toner is shown in Table 2, and the characteristics of the toner are shown in Table 3. The formulation shown in Table 2 is represented in terms of the actual amount of each component excluding the amount of the dispersion medium.

Next, two-component developer 1 was prepared by mixing 8 parts by mass of the toner 1 and 92 parts by mass of the above-described carrier. Then, using this two-component developer, the following evaluations were carried out. The evaluation results are shown in Table 3.

<Low-Temperature Fixability Evaluation>

The above-described two-component developer 1 and a color laser copying machine CLC 5000 (manufactured by Canon Inc.) were used in the evaluation. The development contrast of the copying machine was adjusted so that the toner amount laid on a sheet of paper was 1.2 mg/cm$^2$, and then, in a single-color mode, a "solid" unfixed image with a leading edge margin of 5 mm, width of 100 mm, and length of 280 mm was formed in an ordinary-temperature, ordinary-humidity environment (23° C./60% RH). As paper, thick A4 paper ("Prover Bond" 105 g/m$^2$, manufactured by Neenah Paper, Inc.) was used.

Next, a fixing unit of the CLC 5000 (manufactured by Canon Inc.) was modified so that a fixing temperature could be manually set. Using this modified fixing unit, while increasing the fixing temperature in 10° C. increments in the range of 80° C. to 200° C., fixed images of the "solid" unfixed image were obtained at each temperature in an ordinary-temperature, ordinary-humidity environment (23° C./60%).

Soft, thin paper (e.g., "Dasper" (trade name) manufactured by Ozu Corporation) was laid over the image region of the obtained fixed image. This image region was then rubbed back and forth five times from above the thin paper while applying a load of 4.9 kPa to the image. The image densities of the image before and after the rubbing were measured, and the decreasing rate of the image density ΔD (%) was calculated according to the following equation. Temperature at which ΔD (%) was less than 10% was defined as fixing start temperature, and low-temperature fixability was evaluated based on the following criteria.

The image density was measured with a color reflection densitometer (Color Reflection Densitometer X-Rite 404A, manufactured by X-Rite).

$$\Delta D(\%)=\{(\text{Image density before rubbing}-\text{image density after rubbing})/\text{image density before rubbing}\}\times 100$$

(Evaluation Criteria)

A: Fixing start temperature is 120° C. or less

B: Fixing start temperature is more than 120° C. and 140° C. or less

C: Fixing start temperature is more than 140° C. and 160° C. or less

D: Fixing start temperature is more than 160° C.

<Charging Performance Evaluation>

1.0 g of toner and 19.0 g of a predetermined carrier (The Imaging Society of Japan standard carrier, spherical carrier having a surface treated ferrite core, N-01) were each charged into a plastic bottle provided with a lid, and left standing for 1 day in measurement environments. The measurement environments were N/L (temperature 23.0° C./humidity 5%), and H/H (temperature 30.0° C./humidity 80%).

Figure 2:
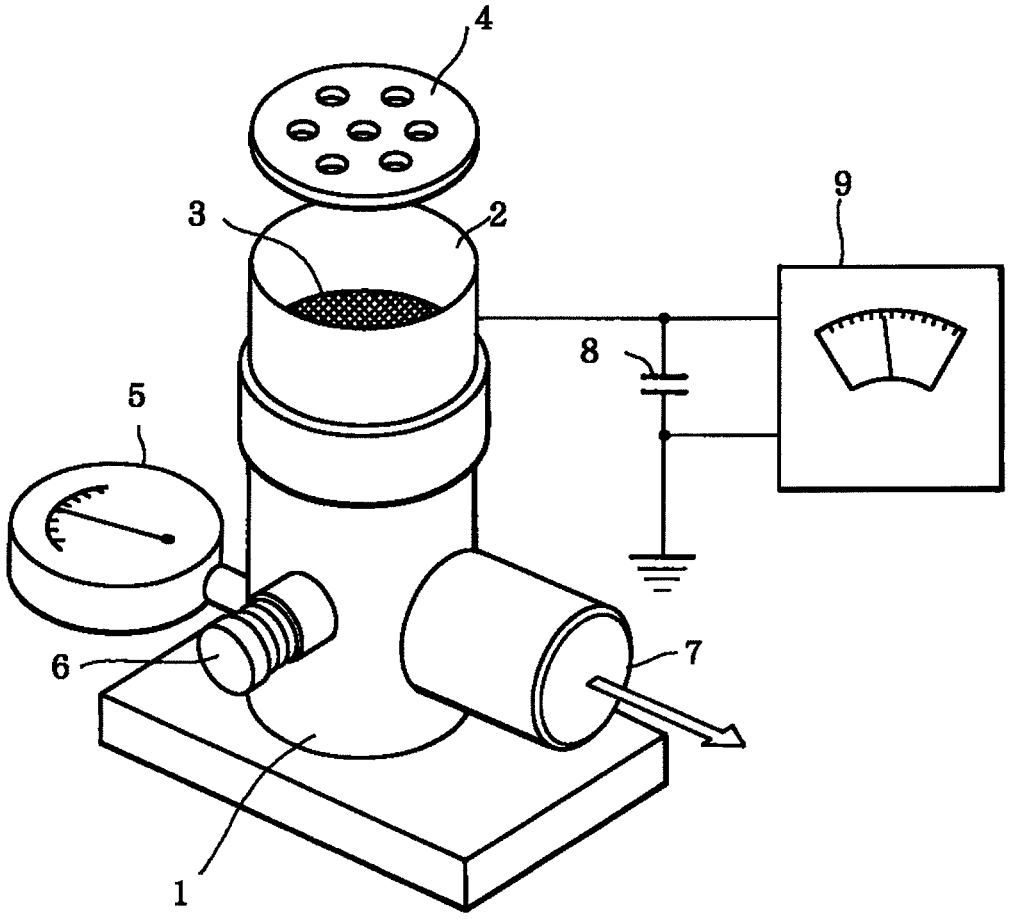
FIG. 2 is a schematic diagram of an apparatus for measuring a triboelectric charge amount.

The plastic bottle containing the toner and the carrier was set on a shaker (YS-LD, manufactured by Yayoi Chemical Industry, Co., Ltd.), and shaken for 1 minute at a speed of 4 reciprocating motions per second, to charge a developer formed from the toner and the carrier. Next, the triboelectric charge amount is measured in an apparatus for measuring triboelectric charge amount illustrated in FIG. 2. In FIG. 2, about 0.5 to 1.5 g of the developer is charged into a metal measurement vessel 2 provided with a 500-mesh (25 μm aperture) screen 3 on the bottom. The measurement vessel 2 is then closed with a metal lid 4. The mass of the whole measurement vessel 2 at this stage is weighed and defined as W1 (g). Next, in an aspirator 1 (in which at least a portion in contact with the measurement vessel 2 is insulated), the air in the measurement vessel is sucked from an aspiration port 7 by adjusting an air flow-regulating valve 6 so as to set the pressure of a vacuum gauge 5 to 250 mmAq. In this state, suction is performed for 2 minutes to remove the toner. The voltage on an electrometer 9 at this point is defined as V (volt). The capacity of a condenser 8 is defined as C (mF). In addition, the mass of the whole measurement vessel after suction is weighed, and is defined as W2 (g). The triboelectric charge amount (mC/kg) of the sample is calculated according to the following equation.

$$\text{Triboelectric charge amount (mC/kg) of the sample} = C \times V/(W1 - W2)$$

As for the N/L environment, after continuing the Yayoi shaking for 1 hour, the charge amount was also measured.

<Heat-Resistant Storage Stability>

About 10 g of toner was charged into a 100-ml plastic cup and left to stand at 50° C. for 3 days. The toner was then visually evaluated.

(Evaluation Criteria)

A: No aggregations are observed.

B: Aggregations are observed, but are easily collapsed.

C: Aggregations can be grabbed, and are not easily collapsed.

<Image Density>

Using the above-described evaluation machine, the toner laid-on amount in a solid image on the color laser copier paper TKCLA4 (Canon Inc.) was adjusted to 0.35 mg/cm$^2$, and a fixed image was formed. The density of the obtained fixed image was measured using a reflection densitometer manufactured by X-rite (500 Series Spectrodensitometer). Image density was evaluated based on the following criteria.

A: Reflection density of 1.50 or more, and sufficient yellow density can be obtained.

B: Reflection density of 1.40 or more to less than 1.50, and density is somewhat low.

C: Reflection density of less than 1.40, and density is low.

<Color Hue Measurement>

Using the above-described evaluation machine, a fixed image was formed on a sheet of paper (color laser copier paper TKCLA4, Canon Inc.) while varying the toner laid-on amount at eight levels (0.05 mg/cm$^2$, 0.10 mg/cm$^2$, 0.15 mg/cm$^2$, 0.20 mg/cm$^2$, 0.25 mg/cm$^2$, 0.30 mg/cm$^2$, 0.35 mg/cm$^2$, and 0.50 mg/cm$^2$). For each of the fixed images, the CIE a* and b* were measured using a Spectroscan manufactured by GretagMacbeth (measurement conditions: D65, viewing angle 2 degrees). Further, the relationship between c* ($=((a^*)^2+(b^*)^2)^{1/2}$) and L* was determined by plotting color hue against the toner laid-on amount at the eight levels, and drawing a curve which smoothly links each point.

Based on this relationship, the value of c* at L*=88 was determined.

The c* can be determined by $c^*=((a^*)^2+(b^*)^2)^{1/2}$ (Evaluation Criteria)

A: c* larger than 77.0.

B: c* larger than 75.0 and 77.0 or less.

C: c* 75.0 or less.

<Evaluation of Character Quality>

Character quality evaluation was performed on the basis of an evaluation of thin line reproducibility.

The above-described two-component developer was used in the evaluation. Further, a commercially-available color copying machine (model: CLC 5000, manufactured by Canon Inc.) was used in the image evaluation. The evaluation of thin line reproducibility was carried out by inspecting an image after 10 sheets were printed during a durability test.

First, a fixed image printed on a sheet of thick paper (105 g/m$^2$) by carrying out laser exposure so that a latent image line width was 85 μm was used as a measurement sample. Using a particle analyzer Luzex 450 (manufactured by Nireco Corporation) as a measurement apparatus, the line width was measured on the basis of an enlarged monitor image by means of an indicator. As the measurement position for the line width, since a toner thin line image has unevenness in the width direction, an average line width of such unevenness was used as a measurement point. The thin line reproducibility was evaluated by calculating the ratio (line width ratio) of the line width measurement value to the latent image line width (85 μm). The thin line reproducibility evaluation criteria were as follows.

(Evaluation Criteria)

A: The ratio (line width ratio) of the line width measurement value to the latent image line width is less than 1.08.

B: The ratio (line width ratio) of the line width measurement value to the latent image line width is 1.08 or more to less than 1.12.

C: The ratio (line width ratio) of the line width measurement value to the latent image line width is 1.12 or more to less than 1.18.

D: The ratio (line width ratio) of the line width measurement value to the latent image line width is 1.18 or more.

Comparative Example 1

Toner 2 was produced through the following steps using an aqueous phase described below instead of the aqueous phase used in Example 1. The toner formulation is shown in Table 2, and the characteristics are shown in Table 3.

(Preparation of Inorganic Aqueous Dispersion Medium)

451 Parts of a 0.1 mol/L aqueous solution of $Na_3PO_4$ was charged into 709 parts of ion-exchange water. The resultant mixture was heated to 60° C., and then the mixture was stirred at 12,000 rpm with a TK-homomixer (manufactured by Primix Corporation). 67.7 Parts of a 1.0 mol/L aqueous solution of $CaCl_2$ were gradually added to prepare an inorganic aqueous dispersion medium containing $Ca_3(PO_4)_2$.

(Emulsifying and Desolvating Steps)

| | |
|---|---|
| Above inorganic aqueous dispersion medium | 200 parts by mass |
| 50% aqueous solution of sodium dodecyl diphenyl ether disulfonate (Eleminol MON-7, manufactured by Sanyo Chemical Industries, Ltd.) | 4 parts by mass |
| Ethyl acetate | 16 parts by mass |

The above materials were charged into a beaker, and stirred at 5,000 rpm for 1 minute with a TK-homomixer to prepare an aqueous phase. The speed of the TM homomixer was increased to 8,000 rpm, and the above-described liquid toner composition 1 (170.5 parts by mass) was charged into the beaker. The resultant mixture was stirred for 3 minutes to suspend the liquid toner composition 1. A stirring blade was set in the beaker, and while stirring at 200 rpm, the temperature in the system was increased to 50° C. to carry out desolvation over 10 hours in a draft chamber, whereby a toner aqueous dispersion was obtained.

(Washing and Drying Step)

Toner particles were obtained in the same manner as in Example 1, except that hydrochloric acid was added to the system so that the pH was 1.5. Next, the toner particles were subjected to the same external addition treatment as in Example 1, to thereby obtain toner 2.

Comparative Example 2

Toner 3 was obtained by the same production method as in Example 1, except that oil phase 2 produced under the following conditions was used instead of oil phase 1. The toner formulation is shown in Table 2, and the toner characteristics are shown in Table 3.

(Preparation of Liquid Toner Composition 2)

| | |
|---|---|
| Wax dispersion 1 (carnuba wax solid content: 20%) | 50 parts by mass |
| Colorant dispersion Y2 (pigment solid content: 40%) | 35 parts by mass |
| Polyester resin solution 1 (resin solid content: 50%) | 152 parts by mass |
| Triethylamine | 0.5 parts by mass |
| Ethyl acetate | 12.5 parts by mass |

The above materials were charged into a vessel, and stirred and dispersed at 1,500 rpm for 10 minutes with a Homo Disper (manufactured by Primix Corporation) to prepare oil phase 2.

Comparative Example 3

Toner 4 was obtained by the same production method as in Example 1, except that oil phase 3 produced under the following conditions was used instead of oil phase 1. The toner formulation is shown in Table 2, and the toner characteristics are shown in Table 3.

(Preparation of Liquid Toner Composition 3)

| | |
|---|---|
| Wax dispersion 1 (carnuba wax solid content: 20%) | 50 parts by mass |
| Colorant dispersion Y1 (pigment solid content: 20%, resin solid content: 20%) | 40 parts by mass |
| Polyester resin solution 1 (resin solid content: 50%) | 148 parts by mass |
| Triethylamine | 0.5 parts by mass |
| Ethyl acetate | 11.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 3.

Comparative Example 4

Toner 5 was obtained by the same production method as in Example 1, except that oil phase 4 produced under the following conditions was used instead of oil phase 1. The toner formulation is shown in Table 2, and the toner characteristics are shown in Table 3.

(Preparation of Liquid Toner Composition 4)

| | |
|---|---|
| Wax dispersion 1 (carnuba wax solid content: 20%) | 50 parts by mass |
| Colorant dispersion Y1 (pigment solid content: 20%, resin solid content: 20%) | 100 parts by mass |
| Polyester resin solution 1 (resin solid content: 50%) | 100 parts by mass |
| Triethylamine | 0.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 4.

Comparative Example 5

Toner 6 was obtained by the same production method as in Example 1, except that oil phase 5 produced under the following conditions was used instead of oil phase 1. The toner formulation is shown in Table 2, and the toner characteristics are shown in Table 3.

(Preparation of Liquid Toner Composition 5)

| | |
|---|---|
| Wax dispersion 1 (carnuba wax solid content: 20%) | 50 parts by mass |
| Colorant dispersion Y3 (pigment solid content: 20%, resin solid content: 20%) | 70 parts by mass |
| Polyester resin solution 2 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 5.

Comparative Example 6

Toner 7 was obtained by the same production method as in Example 1, except that oil phase 6 produced under the following conditions was used instead of oil phase 1. The toner formulation is shown in Table 2, and the toner characteristics are shown in Table 3.

(Preparation of Liquid Toner Composition 6)

| | |
|---|---|
| Wax dispersion 1 (carnuba wax solid content: 20%) | 50 parts by mass |
| Colorant dispersion Y4 (pigment solid content: 20%, resin solid content: 20%) | 70 parts by mass |
| Polyester resin solution 3 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 6.

Comparative Example 7

Toner 8 was obtained by the same production method as in Example 1, except that the oil phase and the aqueous phase described below were used instead of the oil phase and the aqueous phase used in Example 1. The toner formulation is shown in Table 2, and the toner characteristics are shown in Table 3.

(Preparation of Liquid Toner Composition 7)

| | |
|---|---|
| Wax dispersion 1 (carnuba wax solid content: 20%) | 50 parts by mass |
| Colorant dispersion Y1 (pigment solid content: 20%, resin solid content: 20%) | 70 parts by mass |
| Polyester resin solution 1 (resin solid content: 50%) | 124 parts by mass |
| Triethylamine | 0.8 parts by mass |
| Ethyl acetate | 5.2 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 1.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 241.5 parts by mass |
| Resin fine particle dispersion 1 (1.8 parts by mass of resin fine particles with respect to 100 parts by mass of toner base particle) | 9.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Comparative Example 8

Toner 9 was obtained by the same production method as in Example 1, except that the oil phase and the aqueous phase described below were used instead of the oil phase and the aqueous phase used in Example 1. The toner formulation is shown in Table 2, and the toner characteristics are shown in Table 3.

(Preparation of Liquid Toner Composition 8)

| | |
|---|---|
| Wax dispersion 1 (carnuba wax solid content: 20%) | 50 parts by mass |
| Colorant dispersion Y1 (pigment solid content: 20%, resin solid content: 20%) | 70 parts by mass |

-continued

| | |
|---|---|
| Polyester resin solution 1 (resin solid content: 50%) | 124 parts by mass |
| Triethylamine | 0.2 parts by mass |
| Ethyl acetate | 5.8 parts by mass |

The above materials were charged into a vessel, and stirred and dispersed at 1,500 rpm for 10 minutes with a Homo Disper (manufactured by Primix Corporation), and was then dispersed for 30 minutes by means of an ultrasonic disperser at ordinary temperature to prepare oil phase 8.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 165.5 parts by mass |
| Resin fine particle dispersion 1 (17.0 parts by mass of resin fine particles with respect to 100 parts by mass of toner base particle) | 85.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Comparative Example 9

Toner 10 was obtained by the use of the oil phase and the aqueous phase used in Example 1, while changing the emulsifying and desolvating step.

(Emulsifying and Desolvating Step)

The oil phase was charged into the aqueous phase, and was stirred for 5 minutes with a TK-homomixer at 12,000 rpm or less, whereby oil phase 1 was suspended.

Next, a stirring blade was set in the vessel, and while stirring at 200 rpm, the temperature in the system was increased to 50° C. and the pressure in the system was reduced to 500 mmHg to carry out desolvation over 5 hours, so that an aqueous dispersion of toner particles was obtained.

Toner 10 was obtained through the same washing, drying and toner preparation steps as in Example 1. The toner formulation is shown in Table 2, and the toner characteristics are shown in Table 3.

Example 2

Toner 11 was obtained by the same production method as Example 1, except that oil phase 11 produced under the following conditions was used instead of oil phase 1. The toner formulation is shown in Table 2, and the toner characteristics are shown in Table 3.

(Preparation of Liquid Toner Composition 11)

| | |
|---|---|
| Wax dispersion 1 (carnuba wax solid content: 20%) | 50 parts by mass |
| Colorant dispersion Y3 (pigment solid content: 20%, resin solid content: 20%) | 70 parts by mass |
| Polyester resin solution 4 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 11.

Example 3

Toner 12 was obtained by the same production method as in Example 1, except that oil phase 12 produced under the following conditions was used instead of oil phase 1. The toner formulation is shown in Table 2, and the toner characteristics are shown in Table 3.

(Preparation of Liquid Toner Composition 12)

| | |
|---|---|
| Wax dispersion 1 (carnuba wax solid content: 20%) | 50 parts by mass |
| Colorant dispersion Y4 (pigment solid content: 20%, resin solid content: 20%) | 70 parts by mass |
| Polyester resin solution 5 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 12.

Example 4

Toner 13 was obtained by the same production method as in Example 1, except that oil phase 13 produced under the following conditions was used instead of oil phase 1. The toner formulation is shown in Table 2, and the toner characteristics are shown in Table 3.

(Preparation of Liquid Toner Composition 13)

| | |
|---|---|
| Wax dispersion 1 (carnuba wax solid content: 20%) | 50 parts by mass |
| Colorant dispersion Y5 (pigment solid content: 20%, resin solid content: 20%) | 70 parts by mass |
| Polyester resin solution 6 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 13.

Example 5

Toner 14 was obtained by the same production method as in Example 1, except that oil phase 14 produced under the following conditions was used instead of oil phase 1. The toner formulation is shown in Table 2, and the toner characteristics are shown in Table 3.

(Preparation of Liquid Toner Composition 14)

| | |
|---|---|
| Wax dispersion 1 (carnuba wax solid content: 20%) | 50 parts by mass |
| Colorant dispersion Y8 (pigment solid content: 20%, resin solid content: 20%) | 70 parts by mass |
| Polyester resin solution 7 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 14.

Example 6

Toner 15 was obtained by the same production method as in Example 1, except that the oil phase and the aqueous phase described below were used instead of the oil phase and the aqueous phase used in Example 1. The toner formulation is shown in Table 2, and the toner characteristics are shown in Table 3.

(Preparation of Liquid Toner Composition 15)

| | |
|---|---|
| Wax dispersion 1 (carnuba wax solid content: 20%) | 50 parts by mass |
| Colorant dispersion Y1 (pigment solid content: 20%, resin solid content: 20%) | 70 parts by mass |
| Polyester resin solution 1 (resin solid content: 50%) | 124 parts by mass |
| Triethylamine | 0.6 parts by mass |
| Ethyl acetate | 5.4 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 15.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 241.5 parts by mass |
| Resin fine particle dispersion 1 (4.5 parts by mass of resin fine particles with respect to 100 parts by mass of toner base particle) | 9.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 7

Toner 16 was obtained by the same production method as in Example 1, except that the oil phase and the aqueous phase described below were used instead of the oil phase and the aqueous phase used in Example 1. The toner formulation is shown in Table 2, and the toner characteristics are shown in Table 3.

(Preparation of Liquid Toner Composition 16)

| | |
|---|---|
| Wax dispersion 1 (carnuba wax solid content: 20%) | 50 parts by mass |
| Colorant dispersion Y1 (pigment solid content: 20%, resin solid content: 20%) | 70 parts by mass |
| Polyester resin solution 1 (resin solid content: 50%) | 124 parts by mass |
| Triethylamine | 0.4 parts by mass |
| Ethyl acetate | 5.6 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 16.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 180.5 parts by mass |
| Resin fine particle dispersion 1 (14.0 parts by mass of resin fine particles with respect to 100 parts by mass of toner base particle) | 70.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 8

Toner 17 was obtained by the same production method as in Example 1, except that oil phase 17 produced under the following conditions was used instead of oil phase 1. The toner formulation is shown in Table 2, and the toner characteristics are shown in Table 3.

(Preparation of Liquid Toner Composition 17)

| | |
|---|---|
| Wax dispersion 1 (carnuba wax solid content: 20%) | 50 parts by mass |
| Colorant dispersion Y2 (pigment solid content: 40%) | 35 parts by mass |
| Polyester resin solution 1 (resin solid content: 50%) | 152 parts by mass |
| Triethylamine | 0.5 parts by mass |
| Ethyl acetate | 12.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 17.

Example 9

Toner 18 was obtained by the same production method as in Example 1, except that oil phase 18 produced under the following conditions was used instead of oil phase 1. The toner formulation is shown in Table 2, and the toner characteristics are shown in Table 3.

(Preparation of Liquid Toner Composition 18)

| | |
|---|---|
| Wax dispersion 1 (carnuba wax solid content: 20%) | 50 parts by mass |
| Colorant dispersion Y1 (pigment solid content: 20%, resin solid content: 20%) | 45 parts by mass |
| Polyester resin solution 1 (resin solid content: 50%) | 144 parts by mass |
| Triethylamine | 0.5 parts by mass |
| Ethyl acetate | 10.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 18.

Example 10

Toner 19 was obtained by the same production method as in Example 1, except that oil phase 19 produced under the following conditions was used instead of oil phase 1. The toner formulation is shown in Table 2, and the toner characteristics are shown in Table 3.

(Preparation of Liquid Toner Composition 19)

| | |
|---|---|
| Wax dispersion 1 (carnuba wax solid content: 20%) | 50 parts by mass |
| Colorant dispersion Y1 (pigment solid content: 20%, resin solid content: 20%) | 95 parts by mass |
| Polyester resin solution 1 (resin solid content: 50%) | 104 parts by mass |
| Triethylamine | 0.5 parts by mass |
| Ethyl acetate | 0.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 19.

Example 11

Toner 20 was obtained by the same production method as in Example 1, except that oil phase 20 produced under the following conditions was used instead of oil phase 1. The toner formulation is shown in Table 2, and the toner characteristics are shown in Table 3.

(Preparation of Liquid Toner Composition 20)

| | |
|---|---|
| Wax dispersion 1 (carnuba wax solid content: 20%) | 50 parts by mass |
| Colorant dispersion Y1 (pigment solid content: 20%, resin solid content: 20%) | 52.5 parts by mass |
| Polyester resin solution 1 (resin solid content: 50%) | 138 parts by mass |
| Triethylamine | 0.5 parts by mass |
| Ethyl acetate | 9.0 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 20.

Example 12

Toner 21 was obtained by the same production method as in Example 1, except that oil phase 21 produced under the following conditions was used instead of oil phase 1. The toner formulation is shown in Table 2, and the toner characteristics are shown in Table 3.

(Preparation of Liquid Toner Composition 21)

| | |
|---|---|
| Wax dispersion 1 (carnuba wax solid content: 20%) | 50 parts by mass |
| Colorant dispersion Y1 (pigment solid content: 20%, resin solid content: 20%) | 80 parts by mass |
| Polyester resin solution 1 (resin solid content: 50%) | 116 parts by mass |
| Triethylamine | 0.5 parts by mass |
| Ethyl acetate | 3.5 parts by mass |

The above materials were charged into a vessel, and stirred and dispersed at 1,500 rpm for 10 minutes with a Homo Disper (manufactured by Primix Corporation), and were then dispersed for 30 minutes by means of an ultrasonic disperser at ordinary temperature to prepare oil phase 21.

Example 13

Toner 22 was obtained by the same production method as in Example 1, except that the aqueous phase described below was used instead of the aqueous phase used in Example 1. The toner formulation is shown in Table 2, and the toner characteristics are shown in Table 3.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 210.5 parts by mass |
| Resin fine particle dispersion 2 (8 parts by mass of resin fine particles with respect to 100 parts by mass of toner base particle) | 40 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 14

Toner 23 was obtained by the same production method as in Example 1, except that the aqueous phase described below were used instead of the aqueous phase used in Example 1. The toner formulation is shown in Table 2, and the toner characteristics are shown in Table 3.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 210.5 parts by mass |
| Resin fine particle dispersion 3 (8.0 parts by mass of resin fine particles with respect to 100 parts by mass of toner base particle) | 40.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 15

Toner 24 was obtained by the same production method as in Example 1, except that the aqueous phase described below were used instead of the aqueous phase used in Example 1. The toner formulation is shown in Table 2, and the toner characteristics are shown in Table 3.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 210.5 parts by mass |
| Resin fine particle dispersion 4 (8.0 parts by mass of resin fine particles with respect to 100 parts by mass of toner base particle) | 40.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 16

Toner 25 was obtained by the same production method as in Example 1, except that the aqueous phase described below was used instead of the aqueous phase used in Example 1. The toner formulation is shown in Table 2, and the toner characteristics are shown in Table 3.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 210.5 parts by mass |
| Resin fine particle dispersion 5 (8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 17

Preparation of Liquid Toner Composition 26

| | |
|---|---|
| Wax dispersion 1 (carnuba wax solid content: 20%) | 50 parts by mass |
| Colorant dispersion Y1 (pigment solid content: 20%, resin solid content: 20%) | 70 parts by mass |
| Polyester resin solution 1 (resin solid content: 50%) | 124 parts by mass |
| Triethylamine | 0.5 parts by mass |
| Ethyl acetate | 5.5 parts by mass |

The above materials were charged into a vessel, and stirred and dispersed at 1,500 rpm for 10 minutes with a Homo Disper (manufactured by Primix Corporation). Further, the materials were dispersed for 30 minutes under ordinary temperature with an ultrasonic dispersing device to prepare oil phase 26.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 190.5 parts by mass |
| Resin fine particle dispersion 6 (12.0 parts by mass of resin fine particles based on 100 parts by mass of toner base particles) | 60.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

(Emulsifying and Desolvating Steps)

The oil phase was charged into the aqueous phase, and was stirred continuously for 1 minute by means of a TK-homomixer at 8,000 rpm or less, whereby the oil phase 26 was suspended.

Next, a stirring blade was set in the vessel, and stirring was carried out for 5 minutes at 200 rpm under ordinary temperature conditions (23° C.) Next, desolvation was carried out over 5 hours under the conditions that the temperature in the system was raised to 50° C. and the pressure was reduced to 500 mmHg, whereby an aqueous dispersion of toner particles was obtained.

Subsequently, the same procedures as in Example 1 were performed to produce toner 26. The toner formulation is shown in Table 2, and the toner characteristics are shown in Table 3.

Example 18

Toner 27 was obtained by the same production method as in Example 1, except that the aqueous phase described below was used instead of the aqueous phase used in Example 1. The toner formulation is shown in Table 2, and the toner characteristics are shown in Table 3.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchange water | 220.5 parts by mass |
| Resin fine particle dispersion 7 (6.0 parts by mass of resin fine particles based on 100 parts by mass of toner base particles) | 30.0 parts by mass |
| 50% Aqueous solution of sodium dodecyl diphenyl ether disulfonate (Eleminol MON-7 manufactured by Sanyo Chemical Industries, Ltd.) | 25.0 parts by mass |
| Ethyl acetate | 30.0 parts by mass |

Example 19

Toner 28 was obtained by the same production method as in Example 1, except that oil phase 28 produced under the following conditions was used instead of oil phase 1. The toner formulation is shown in Table 2, and the toner characteristics are shown in Table 3.

(Preparation of Liquid Toner Composition 28)

| | |
|---|---|
| Wax dispersion 1 (carnuba wax solid content: 20%) | 50 parts by mass |
| Colorant dispersion Y9 (pigment solid content: 20%, resin solid content: 30%) | 70 parts by mass |
| Polyester resin solution 1 (resin solid content: 50%) | 110 parts by mass |
| Triethylamine | 0.5 parts by mass |
| Ethyl acetate | 19.5 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 28.

Example 20

Toner 29 was obtained by the same production method as in Example 1, except that oil phase 29 produced under the following conditions was used instead of oil phase 1. The toner formulation is shown in Table 2, and the toner characteristics are shown in Table 3.

(Preparation of Liquid Toner Composition 29)

| | |
|---|---|
| Wax dispersion 1 (carnuba wax solid content: 20%) | 50 parts by mass |
| Colorant dispersion Y10 (pigment solid content: 20%, resin solid content: 30%) | 70 parts by mass |
| Polyester resin solution 1 (resin solid content: 50%) | 110 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 29.

Example 21

Toner 30 was obtained by the same production method as in Example 1, except that oil phase 30 produced under the following conditions was used instead of oil phase 1. The toner formulation is shown in Table 2, and the toner characteristics are shown in Table 3.

(Preparation of Liquid Toner Composition 30)

| | |
|---|---|
| Wax dispersion 1 (carnuba wax solid content: 20%) | 40 parts by mass |
| Colorant dispersion Y11 (pigment solid content: 20%, resin solid content: 20%) | 70 parts by mass |
| Polyester resin solution 8 (resin solid content: 50%) | 128 parts by mass |
| Triethylamine | 0.5 parts by mass |
| Ethyl acetate | 11.5 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 30.

Example 22

Toner 31 was obtained by the same production method as in Example 1, except that oil phase 31 produced under the following conditions was used instead of oil phase 1. The toner formulation is shown in Table 2, and the toner characteristics are shown in Table 3.

(Preparation of Liquid Toner Composition 11)

| | |
|---|---|
| Wax dispersion 1 (carnuba wax solid content: 20%) | 70 parts by mass |
| Colorant dispersion Y12 (pigment solid content: 20%, resin solid content: 20%) | 70 parts by mass |
| Polyester resin solution 9 (resin solid content: 50%) | 116 parts by mass |
| Triethylamine | 0.5 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 31.

Example 23

Toner 31 was obtained by the same production method as in Example 1, except that the emulsifying and desolvating step of Example 1 was changed as follows.

(Emulsifying and Desolvating Steps)

The oil phase was charged into the aqueous phase, and was stirred continuously for 1 minute by means of a TK-homomixer at 8,000 rpm or less, whereby the oil phase 26 was suspended.

Then, a stirring blade was set in the vessel, and stirring was carried out for 5 minutes at 200 rpm under ordinary temperature conditions (23° C.) Next, 500 parts by mass of ion-exchange water was added, and then desolvation was carried out over 5 hours under the conditions that the temperature in the system was raised to 50° C. and the pressure was reduced to 500 mmHg, whereby an aqueous dispersion of toner particles was obtained.

Example 24

Toner 33 was obtained by the same production method as in Example 1, except that oil phase 33 produced under the following conditions was used instead of oil phase 1. The toner formulation is shown in Table 2, and the toner characteristics are shown in Table 3.

(Preparation of Liquid Toner Composition 33)

| | |
|---|---|
| Wax dispersion 2 (wax solid content: 16%, nitrile group-containing styrene acrylic resin: 8%) | 75 parts by mass |
| Colorant dispersion Y13 (pigment solid content: 20%, resin solid content: 20%) | 70 parts by mass |
| Polyester resin solution 1 (resin solid content: 50%) | 108 parts by mass |
| Triethylamine | 0.5 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 33.

Example 25

Toner 34 was obtained by the same production method as in Example 1, except that oil phase 33 produced under the following conditions was used instead of oil phase 1. The toner formulation is shown in Table 2, and the toner characteristics are shown in Table 3.

(Preparation of Liquid Toner Composition 34)

| | |
|---|---|
| Wax dispersion 3 (wax solid content: 16%, nitrile group-containing styrene acrylic resin: 8%) | 37.5 parts by mass |
| Colorant dispersion Y13 (pigment solid content: 20%, resin solid content: 20%) | 70 parts by mass |
| Polyester resin solution 1 (resin solid content: 50%) | 126 parts by mass |
| Triethylamine | 0.5 parts by mass |
| Ethyl acetate | 16.0 parts by mass |

The above materials were charged into a vessel, and stirred and dispersed at 1,500 rpm for 10 minutes with a Homo Disper (manufactured by Primix Corporation), and were then dispersed for 30 minutes by an ultrasonic disperser at ordinary temperature to prepare oil phase 33.

TABLE 2

| | Core | | | | | | | | | | | |
|---|---|---|---|---|---|---|---|---|---|---|---|---|
| | Resin (a1) | | WAX | | Added Agent | | Colorant | | Resin for Colorant Dispersion | | Shell Resin (b) | |
| | Type | Added Amount (parts by mass) | Type | Added Amount (parts by mass) | Type | Added Amount (parts by mass) | Type*1) | Added Amount (parts by mass) | Type*2) | Added Amount (parts by mass) | Type | Added Amount (parts by mass) |
| Toner 1 | Polyester 1 | 62.0 | Carnuba-1 | 10.0 | — | — | PY-74 | 14.0 | Polyester 1 | 14.0 | b-1 | 8.0 |
| Toner 2 | Polyester 1 | 62.0 | Carnuba-1 | 10.0 | — | — | PY-74 | 14.0 | Polyester 1 | 14.0 | — | — |
| Toner 3 | Polyester 1 | 76.0 | Carnuba-1 | 10.0 | — | — | PY-74 | 14.0 | — | — | b-1 | 8.0 |
| Toner 4 | Polyester 1 | 74.0 | Carnuba-1 | 10.0 | — | — | PY-74 | 8.0 | Polyester 1 | 8.0 | b-1 | 8.0 |
| Toner 5 | Polyester 1 | 50.0 | Carnuba-1 | 10.0 | — | — | PY-74 | 20.0 | Polyester 1 | 20.0 | b-1 | 8.0 |
| Toner 6 | Polyester 2 | 62.0 | Carnuba-1 | 10.0 | — | — | PY-74 | 14.0 | Polyester 2 | 8.0 | b-1 | 8.0 |
| Toner 7 | Polyester 3 | 62.0 | Carnuba-1 | 10.0 | — | — | PY-74 | 14.0 | Polyester 3 | 8.0 | b-1 | 8.0 |
| Toner 8 | Polyester 1 | 62.0 | Carnuba-1 | 10.0 | — | — | PY-74 | 14.0 | Polyester 1 | 8.0 | b-1 | 1.8 |
| Toner 9 | Polyester 1 | 62.0 | Carnuba-1 | 10.0 | — | — | PY-74 | 14.0 | Polyester 1 | 8.0 | b-1 | 17.0 |
| Toner 10 | Polyester 1 | 62.0 | Carnuba-1 | 10.0 | — | — | PY-74 | 14.0 | Polyester 1 | 8.0 | b-1 | 8.0 |
| Toner 11 | Polyester 4 | 62.0 | Carnuba-1 | 10.0 | — | — | PY-74 | 14.0 | Polyester 4 | 8.0 | b-1 | 8.0 |
| Toner 12 | Polyester 5 | 62.0 | Carnuba-1 | 10.0 | — | — | PY-74 | 14.0 | Polyester 5 | 8.0 | b-1 | 8.0 |
| Toner 13 | Polyester 6 | 62.0 | Carnuba-1 | 10.0 | — | — | PY-74 | 14.0 | Polyester 6 | 8.0 | b-1 | 8.0 |
| Toner 14 | Polyester 7 | 62.0 | Carnuba-1 | 10.0 | — | — | PY-74 | 14.0 | Polyester 7 | 8.0 | b-1 | 8.0 |
| Toner 15 | Polyester 1 | 62.0 | Carnuba-1 | 10.0 | — | — | PY-74 | 14.0 | Polyester 1 | 8.0 | b-2 | 4.5 |
| Toner 16 | Polyester 1 | 62.0 | Carnuba-1 | 10.0 | — | — | PY-74 | 14.0 | Polyester 1 | 8.0 | b-3 | 14.0 |
| Toner 17 | Polyester 1 | 76.0 | Carnuba-1 | 10.0 | — | — | PY-74 | 14.0 | — | — | b-1 | 8.0 |
| Toner 18 | Polyester 1 | 72.0 | Carnuba-1 | 10.0 | — | — | PY-74 | 9.0 | Polyester 1 | 9.0 | b-1 | 8.0 |
| Toner 19 | Polyester 1 | 52.0 | Carnuba-1 | 10.0 | — | — | PY-74 | 19.0 | Polyester 1 | 19.0 | b-1 | 8.0 |
| Toner 20 | Polyester 1 | 69.0 | Carnuba-1 | 10.0 | — | — | PY-74 | 10.5 | Polyester 1 | 10.5 | b-1 | 8.0 |
| Toner 21 | Polyester 1 | 58.0 | Carnuba-1 | 10.0 | — | — | PY-74 | 16.0 | Polyester 1 | 16.0 | b-1 | 8.0 |
| Toner 22 | Polyester 1 | 62.0 | Carnuba-1 | 10.0 | — | — | PY-74 | 14.0 | Polyester 1 | 14.0 | b-2 | 8.0 |
| Toner 23 | Polyester 1 | 62.0 | Carnuba-1 | 10.0 | — | — | PY-74 | 14.0 | Polyester 1 | 14.0 | b-3 | 8.0 |
| Toner 24 | Polyester 1 | 62.0 | Carnuba-1 | 10.0 | — | — | PY-74 | 14.0 | Polyester 1 | 14.0 | b-4 | 8.0 |
| Toner 25 | Polyester 1 | 62.0 | Carnuba-1 | 10.0 | — | — | PY-74 | 14.0 | Polyester 1 | 14.0 | b-5 | 8.0 |
| Toner 26 | Polyester 1 | 62.0 | Carnuba-1 | 10.0 | — | — | PY-74 | 14.0 | Polyester 1 | 14.0 | b-6 | 12.0 |
| Toner 27 | Polyester 1 | 62.0 | Carnuba-1 | 10.0 | — | — | PY-74 | 14.0 | Polyester 1 | 14.0 | b-7 | 6.0 |
| Toner 28 | Polyester 1 | 55.0 | Carnuba-1 | 10.0 | — | — | PY-74 | 14.0 | Polyester 1 | 21.0 | b-1 | 8.0 |
| Toner 29 | Polyester 1 | 55.0 | Carnuba-1 | 10.0 | — | — | PY-74 | 14.0 | Polyester 1 | 21.0 | b-1 | 8.0 |
| Toner 30 | Polyester 8 | 64.0 | Carnuba-1 | 8.0 | — | — | PY-74 | 14.0 | Polyester 8 | 14.0 | b-1 | 8.0 |
| Toner 31 | Polyester 9 | 58.0 | Carnuba-1 | 14.0 | — | — | PY-74 | 14.0 | Polyester 9 | 14.0 | b-1 | 8.0 |
| Toner 32 | Polyester 1 | 62.0 | Carnuba-1 | 10.0 | — | — | PY-74 | 14.0 | Polyester 1 | 14.0 | b-1 | 8.0 |
| Toner 33 | Polyester 1 | 54.0 | Ester-1 | 12.0 | Dispersant-1 | 6.0 | PY-155 | 14.0 | Polyester 1 | 14.0 | b-1 | 8.0 |
| Toner 34 | Polyester 1 | 63.0 | Ester-2 | 6.0 | Dispersant-1 | 3.0 | PY-155 | 14.0 | Polyester 1 | 14.0 | b-1 | 8.0 |

*1)C.I. Pigment Yellow is described as "PY".

*2)The nitrile group-containing styrene acrylic resin is indicated as "Dispersant-1".

TABLE 3

| | | Particle Size | | Tg according to DSC | | | Light Absorbance | | Visco- | | Percentage by number of |
|---|---|---|---|---|---|---|---|---|---|---|---|
| | | (D4) μm | D4/D1 | Tg (0.5) | Tg (4.0) | Tg (4.0)-Tg (0.5) | A(Ethyl-Acetate)$_{422}$/$C_{y1}$ | A(Chloro-form)$_{422}$/$C_{y2}$ | elasticity G' (130) | Average Circularity | 2 μm or less particles |
| Ex. 1 | Toner 1 | 5.8 | 1.14 | 48.3 | 53.5 | 5.2 | 0.02 | 9.72 | $1.7 \times 10^4$ | 0.978 | 0.9 |
| Com. Ex. 1 | Toner 2 | 5.8 | 1.19 | 48.2 | 48.3 | 0.1 | 9.40 | 9.70 | $1.4 \times 10^4$ | 0.982 | 1.7 |
| Com. Ex. 2 | Toner 3 | 5.8 | 1.24 | 48.3 | 53.4 | 5.1 | 0.63 | 9.61 | $1.6 \times 10^4$ | 0.984 | 1.1 |
| Com. Ex. 3 | Toner 4 | 5.7 | 1.14 | 48.2 | 53.3 | 5.1 | 0.01 | 5.81 | $9.6 \times 10^8$ | 0.979 | 1.3 |
| Com. Ex. 4 | Toner 5 | 5.8 | 1.12 | 48.4 | 53.7 | 5.3 | 0.27 | 15.1 | $2.5 \times 10^4$ | 0.979 | 1.4 |
| Com. Ex. 5 | Toner 6 | 5.8 | 1.14 | 38.7 | 43.9 | 5.2 | 0.02 | 9.82 | $8.2 \times 10^2$ | 0.981 | 1.1 |
| Com. Ex. 6 | Toner 7 | 5.6 | 1.15 | 63.3 | 68.4 | 5.1 | 0.04 | 9.76 | $1.9 \times 10^5$ | 0.978 | 1.1 |
| Com. Ex. 7 | Toner 8 | 5.7 | 1.14 | 48.2 | 49.8 | 1.6 | 0.12 | 9.62 | $1.5 \times 10^4$ | 0.980 | 1.3 |
| Com. Ex. 8 | Toner 9 | 5.8 | 1.16 | 48.3 | 59.8 | 11.5 | 0.03 | 9.74 | $2.3 \times 10^4$ | 0.981 | 1.2 |
| Com. Ex. 9 | Toner 10 | 5.7 | 1.17 | 48.2 | 48.5 | 0.3 | 1.30 | 9.73 | $1.2 \times 10^4$ | 0.979 | 1.2 |
| Ex. 2 | Toner 11 | 5.8 | 1.16 | 41.2 | 46.3 | 5.1 | 0.03 | 9.84 | $1.8 \times 10^8$ | 0.981 | 1.0 |
| Ex. 3 | Toner 12 | 5.8 | 1.15 | 59.3 | 64.6 | 5.3 | 0.02 | 9.65 | 9.2 × 104 | 0.978 | 1.1 |
| Ex. 4 | Toner 13 | 5.8 | 1.15 | 43.3 | 48.5 | 5.2 | 0.02 | 9.63 | $6.5 \times 10^8$ | 0.982 | 0.9 |

TABLE 3-continued

| | | | | | | | | | | | |
|---|---|---|---|---|---|---|---|---|---|---|---|
| Ex. 5 | Toner 14 | 5.8 | 1.14 | 57.4 | 62.5 | 5.1 | 0.01 | 9.60 | $5.3 \times 10^4$ | 0.981 | 1.0 |
| Ex. 6 | Toner 15 | 5.8 | 1.16 | 48.3 | 50.4 | 2.1 | 0.04 | 9.87 | $1.6 \times 10^4$ | 0.979 | 0.9 |
| Ex. 7 | Toner 16 | 5.8 | 1.12 | 48.3 | 58.1 | 9.8 | 0.03 | 9.74 | $2.2 \times 10^4$ | 0.976 | 1.1 |
| Ex. 8 | Toner 17 | 5.8 | 1.11 | 48.2 | 53.4 | 5.2 | 0.44 | 9.84 | $1.5 \times 10^4$ | 0.982 | 0.9 |
| Ex. 9 | Toner 18 | 5.8 | 1.15 | 48.2 | 53.4 | 5.2 | 0.01 | 6.12 | $1.1 \times 10^4$ | 0.974 | 0.8 |
| Ex. 10 | Toner 19 | 5.8 | 1.16 | 48.4 | 53.7 | 5.3 | 0.17 | 14.3 | $2.3 \times 10^4$ | 0.980 | 0.9 |
| Ex. 11 | Toner 20 | 5.8 | 1.14 | 48.3 | 53.5 | 5.2 | 0.01 | 7.16 | $1.3 \times 10^4$ | 0.982 | 1.0 |
| Ex. 12 | Toner 21 | 5.8 | 1.13 | 48.3 | 53.4 | 5.1 | 0.11 | 11.8 | $2.1 \times 10^4$ | 0.976 | 0.8 |
| Ex. 13 | Toner 22 | 5.8 | 1.14 | 48.3 | 51.1 | 2.8 | 0.03 | 9.74 | $1.9 \times 10^4$ | 0.978 | 0.9 |
| Ex. 14 | Toner 23 | 5.7 | 1.17 | 48.3 | 56.4 | 8.1 | 0.02 | 9.63 | 1.5 × 104 | 0.981 | 1.1 |
| Ex. 15 | Toner 24 | 5.8 | 1.16 | 48.3 | 51.5 | 3.2 | 0.04 | 9.89 | 2.0 × 104 | 0.973 | 1.1 |
| Ex. 16 | Toner 25 | 5.8 | 1.15 | 48.2 | 55.8 | 7.6 | 0.02 | 9.65 | $1.6 \times 10^4$ | 0.988 | 1.2 |
| Ex. 17 | Toner 26 | 5.7 | 1.14 | 48.2 | 53.5 | 5.3 | 0.03 | 9.76 | $1.4 \times 10^4$ | 0.976 | 1.0 |
| Ex. 18 | Toner 27 | 5.8 | 1.14 | 48.4 | 53.5 | 5.1 | 0.03 | 9.72 | $2.1 \times 10^4$ | 0.980 | 0.8 |
| Ex. 19 | Toner 28 | 5.8 | 1.12 | 48.5 | 54.1 | 5.6 | 0.02 | 9.80 | $2.4 \times 10^4$ | 0.986 | 1.2 |
| Ex. 20 | Toner 29 | 5.8 | 1.11 | 48.6 | 53.7 | 5.1 | 0.02 | 9.78 | $2.6 \times 10^4$ | 0.979 | 0.9 |
| Ex. 21 | Toner 30 | 5.7 | 1.13 | 53.1 | 58.2 | 5.1 | 0.03 | 9.86 | $1.5 \times 10^4$ | 0.981 | 1.8 |
| Ex. 22 | Toner 31 | 6.4 | 1.16 | 54.8 | 60.0 | 5.2 | 0.04 | 9.71 | $1.6 \times 10^4$ | 0.978 | 0.9 |
| Ex. 23 | Toner 32 | 4.8 | 1.14 | 48.3 | 53.7 | 5.4 | 0.02 | 9.74 | $1.4 \times 10^4$ | 0.962 | 2.3 |
| Ex. 24 | Toner 33 | 4.2 | 1.16 | 48.2 | 53.3 | 5.1 | 0.04 | 9.82 | $3.2 \times 10^4$ | 0.982 | 1.1 |
| Ex. 25 | Toner 34 | 8.7 | 1.17 | 48.2 | 53.5 | 5.3 | 0.03 | 9.61 | $8.6 \times 10^8$ | 0.980 | 0.9 |

| | Heat-Resistant Storage Stability | | Low-Temperature | N/L Triboelectric Charge | | H/H | Image | | |
|---|---|---|---|---|---|---|---|---|---|
| | Toner | Image | Fixability | Initial | After Rotating for 1 Hour | triboelectric Charge | Image Density | Chroma c* | Character Quality |
| Ex. 1 | A | A | A | −38.9 | −38.1 | −37.2 | A | A | A |
| Com. Ex. 1 | C | A | A | −53.4 | −38.9 | −41.2 | A | A | B |
| Com. Ex. 2 | A | A | A | −48.6 | −36.4 | −40.2 | A | C | B |
| Com. Ex. 3 | A | A | A | −38.3 | −38.0 | −37.2 | C | A | A |
| Com. Ex. 4 | A | A | A | −38.6 | −37.8 | 36.4 | A | C | A |
| Com. Ex. 5 | B | C | A | −38.4 | −37.1 | −37.1 | A | A | A |
| Com. Ex. 6 | A | A | C | −37.8 | −36.8 | −35.9 | A | A | A |
| Com. Ex. 7 | C | A | A | −36.8 | −28.4 | −29.8 | A | A | A |
| Com. Ex. 8 | A | A | C | −37.2 | −35.4 | −35.4 | A | A | A |
| Com. Ex. 9 | C | A | A | −38.6 | −29.3 | −30.2 | A | A | B |
| Ex. 2 | A | B | A | −38.4 | −36.7 | −36.5 | A | A | A |
| Ex. 3 | A | A | B | −37.6 | −36.4 | −36.1 | A | B | A |
| Ex. 4 | A | A | A | −37.4 | −36.2 | −36.4 | A | A | A |
| Ex. 5 | A | A | A | −38.6 | −36.1 | −37.2 | A | A | A |
| Ex. 6 | B | A | A | −38.9 | −37.3 | −36.4 | A | A | A |
| Ex. 7 | A | A | B | −37.9 | −36.4 | −36.1 | A | A | A |
| Ex. 8 | A | A | A | −38.4 | −33.8 | −34.2 | A | A | A |
| Ex. 9 | A | A | A | −37.1 | −36.1 | −35.8 | B | A | A |
| Ex. 10 | A | A | A | −36.0 | −34.2 | −34.4 | A | B | A |
| Ex. 11 | A | A | A | −36.2 | −34.7 | −35.1 | A | A | A |
| Ex. 12 | A | A | A | −36.1 | −34.5 | −34.9 | A | A | A |
| Ex. 13 | B | A | A | −38.5 | −36.9 | −37.2 | A | A | A |
| Ex. 14 | A | A | B | −37.6 | −36.4 | −36.3 | A | A | A |
| Ex. 15 | A | A | A | −36.7 | −34.9 | −35.1 | A | A | A |
| Ex. 16 | A | A | A | −39.2 | −38.1 | −37.9 | A | A | A |
| Ex. 17 | A | A | A | −38.3 | −36.6 | −37.2 | A | A | A |
| Ex. 18 | A | A | A | −34.6 | −33.1 | −33.3 | A | A | A |
| Ex. 19 | A | A | A | −36.1 | −34.8 | −35.2 | A | B | A |
| Ex. 20 | A | A | A | −38.0 | −36.5 | −36.9 | A | A | A |
| Ex. 21 | A | A | A | −40.2 | −40.7 | −36.4 | A | A | A |
| Ex. 22 | A | A | A | −41.2 | −42.6 | −39.7 | A | A | B |
| Ex. 23 | A | A | A | −38.7 | −37.6 | −37.1 | A | A | B |
| Ex. 24 | A | A | A | −38.4 | −37.1 | −36.9 | A | A | A |
| Ex. 25 | A | A | A | −36.5 | −35.2 | −34.8 | A | A | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-046212, filed Feb. 27, 2009, which is hereby incorporated by reference herein in its entirety.

The invention claimed is:

1. A yellow toner comprising at least a resin (a) having a polyester as a main component, a colorant, and a wax, and satisfying the following formulas (1) and (2) in DSC measurement:

$$40.0 \leqq Tg(0.5) \leqq 60.0 \quad (1)$$

$$2.0 \leqq Tg(4.0) - Tg(0.5) \leqq 10.0 \quad (2)$$

(wherein Tg(0.5) is a glass transition temperature (° C.) obtained at a rate of temperature increase of 0.5° C./min, and Tg(4.0) is a glass transition temperature (° C.) obtained at a rate of temperature increase of 4.0° C./min)

wherein when the concentration of the yellow toner in an ethyl acetate dispersion is $C_{y1}$ (mg/ml), and the light absorbance at a wavelength of 422 nm of the dispersion is $A(\text{ethyl acetate})_{422}$, a relationship between $C_{y1}$ and $A(\text{ethyl acetate})_{422}$ satisfies the following formula (3):

$$A(\text{ethyl acetate})_{422}/C_{y1}<0.45 \quad (3)$$

and when the concentration of the yellow toner in a chloroform solution is $C_{y2}$ (mg/ml), and the light absorbance at a wavelength of 422 nm of the solution is $A(\text{chloroform})_{422}$, a relationship between $C_{y2}$ and $A(\text{chloroform})_{422}$ satisfies the following formula (4):

$$6.00<A(\text{chloroform})_{422}/C_{y2}<14.4 \quad (4).$$

2. The yellow toner according to claim 1, wherein the yellow toner comprises toner particles each having a surface layer (B) containing a resin (b) as a main component on the surface of each toner base particle (A) containing at least the resin (a) which has a polyester as a main component, the colorant and the wax, wherein when a glass transition temperature (° C.) of the resin (b) is Tg(b), and a glass transition temperature (° C.) of the resin (a) is Tg(a), the following relationships are satisfied:

$$40.0 \leqq Tg(a) \leqq 60.0 \quad (5)$$

$$50.0 \leqq Tg(b) \leqq 80.0 \quad (6)$$

$$Tg(a)+5 \leqq Tg(b) \quad (7).$$

3. The yellow toner according to claim 2, wherein the toner particles are obtained by dispersing a dissolved product or a dispersion product obtained by dissolving or dispersing at least the resin (a), a pigment as the colorant and the wax in an organic medium, in an aqueous medium in which fine particles having the resin (b) as a main component are dispersed, removing the organic medium from a resultant dispersion, and drying a resultant product.

4. The yellow toner according to claim 2, wherein the resin (b) is a resin selected from the group consisting of a urethane resin, a polyether resin, and a vinyl resin containing a vinyl unit represented by the following general formula (1):

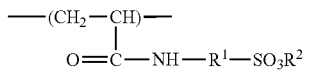

(1)

wherein $R^1$ represents an aromatic or aliphatic hydrocarbon group, and $R^2$ represents a proton or an aliphatic hydrocarbon group.

5. The yellow toner according to claim 2, wherein the surface layer (B) containing the resin (b) as a main component is formed from resin fine particles having an average particle size of 50 nm or more and 300 nm or less.

6. The yellow toner according to claim 2, wherein the surface layer (B) accounts for 2.0 mass % or more and 15.0 mass % or less of the toner base particles (A).

7. The yellow toner according to claim 1, wherein the yellow toner has a ratio D4/D1 of a weight average particle size (D4) to a number average particle size (D1) of 1.25 or less.

8. The yellow toner according to claim 1, characterized in that, in the viscoelasticity measurement, the yellow toner has a storage elastic modulus G' (130) at 130° C. of $1.0\times10^3$ dN/m$^2$ or more and $1.0\times10^5$ dN/m$^2$ or less.

* * * * *